US011529751B2

(12) United States Patent
Asprone et al.

(10) Patent No.: US 11,529,751 B2
(45) Date of Patent: Dec. 20, 2022

(54) STRUCTURE OF REINFORCED CEMENTITIOUS MATERIAL AND PROCESS OF MAKING THE SAME STRUCTURE BY A THREE-DIMENSIONAL PRINTING PROCESS

(71) Applicants: Domenico Asprone, Naples (IT); Ferdinando Auricchio, Milan (IT); Costantino Menna, Carbonara di Nola (IT)

(72) Inventors: Domenico Asprone, Naples (IT); Ferdinando Auricchio, Milan (IT); Costantino Menna, Carbonara di Nola (IT)

( * ) Notice: Subject to any disclaimer, the term of this patent is extended or adjusted under 35 U.S.C. 154(b) by 974 days.

(21) Appl. No.: 16/319,660

(22) PCT Filed: Jul. 20, 2017

(86) PCT No.: PCT/IB2017/054402
§ 371 (c)(1),
(2) Date: Jan. 22, 2019

(87) PCT Pub. No.: WO2018/015920
PCT Pub. Date: Jan. 25, 2018

(65) Prior Publication Data

US 2019/0329447 A1 Oct. 31, 2019

(30) Foreign Application Priority Data

Jul. 22, 2016 (IT) ..... 102016000077424

(51) Int. Cl.
*E04B 2/18* (2006.01)
*E04B 2/02* (2006.01)
(Continued)

(52) U.S. Cl.
CPC ..... *B28B 1/001* (2013.01); *B28B 23/22* (2013.01); *E04B 2/18* (2013.01); *E04B 5/08* (2013.01);
(Continued)

(58) Field of Classification Search
CPC ... E04B 5/08; E04B 1/04; E04B 1/043; E04B 1/046; E04B 1/21; E04B 1/215;
(Continued)

(56) References Cited

U.S. PATENT DOCUMENTS 1,552,077 A * 9/1925 Palanti ..... E04B 2/18 52/286
2,108,396 A * 2/1938 Van Antwerp ..... E04B 2/14 52/437
(Continued)

FOREIGN PATENT DOCUMENTS

BE 463520 A 2/1947
DE 10 2014 206697 A1 10/2015
(Continued)

OTHER PUBLICATIONS

Nov. 17, 2017 International Search Report issued in International Patent Application No. PCT/IB2017/054402.
(Continued)

*Primary Examiner* — Kyle J. Walraed-Sullivan
(74) *Attorney, Agent, or Firm* — Mh2 Technology Law Group LLP

(57) ABSTRACT

A structure has a plurality of modules of cementitious material; a first module exhibiting a reciprocal coupling surface and hooking portions defining at least one cavity, a second module exhibiting a respective reciprocal coupling surface—countershaped and in contact with the reciprocal coupling surface of the first module—and a hooking portion defining at least one cavity extending along at least partially
(Continued)

the stratification direction; a connecting element engaged, on one side, inside the cavity of the hooking portion of the first module and, on the other side, inside the cavity of the hooking portion of the second module. The connecting element is configured for stably constraining the first and second modules and holding these latter in contact with each other. Further, a process makes a structure of reinforced cementitious material.

18 Claims, 12 Drawing Sheets

(51) Int. Cl.

| | |
|---|---|
| ***B28B 1/00*** | (2006.01) |
| ***B28B 23/22*** | (2006.01) |
| *E04B 5/08* | (2006.01) |
| *E04C 2/04* | (2006.01) |
| *E04C 3/22* | (2006.01) |
| *E04C 3/02* | (2006.01) |

(52) U.S. Cl.
CPC ..... *E04B 2002/0254* (2013.01); *E04C 2/041* (2013.01); *E04C 3/22* (2013.01); *E04C 2003/026* (2013.01)

(58) Field of Classification Search
CPC ..... E04B 1/20; E04B 2/02; E04B 2/14; E04B 2/18; E04B 2/20; E04B 2/26; E04B 2/24; E04B 2/46; E04B 2/48; E04B 2002/0206; E04B 2002/0208; E04B 2002/021; E04B 2002/0215; E04B 2002/0217; E04B 2002/0219; E04B 2002/0221; E04B 2002/0226; E04B 2002/0228; E04B 2002/023; E04B 2002/0232; E04B 2002/0234; E04B 2002/0236; E04B 2002/0243; E04B 2002/0245; E04B 2002/0247; E04B 2002/025; E04B 2002/0254; E04C 3/22; E04C 2003/026; E04C 1/00; E04C 1/24; E04C 2/04; E04C 2/041; E04C 2/044; E04C 2/40; E04C 2002/045; E04C 2002/047; E04C 2002/048; B28B 1/001
See application file for complete search history.

(56) References Cited

U.S. PATENT DOCUMENTS 3,795,079 A * 3/1974 Klem ..... E04B 2/20 52/603
3,906,665 A * 9/1975 Medlin ..... A01G 9/027 52/590.1
4,041,670 A * 8/1977 Kaplan ..... E04B 2/18 52/592.2
4,115,980 A * 9/1978 Martel ..... E04B 2/46 446/87
4,182,092 A * 1/1980 Weaver ..... E04G 21/126 52/584.1
4,324,080 A * 4/1982 Mullins ..... B28B 11/12 52/425
4,433,516 A * 2/1984 Fricker ..... E04B 1/043 52/587.1
4,475,326 A * 10/1984 Hanson ..... E04C 1/40 52/286
4,781,006 A * 11/1988 Haynes ..... E04B 1/215 52/601
5,193,320 A * 3/1993 Coccagna ..... E04G 21/1883 52/308
5,230,195 A * 7/1993 Sease ..... E04B 2/18 52/603
5,775,046 A * 7/1998 Fanger ..... A47B 81/061 108/158.12
6,030,199 A * 2/2000 Tseng ..... B29C 41/52 425/375
6,058,672 A * 5/2000 McClellan ..... E04B 1/04 52/592.1
6,178,714 B1 * 1/2001 Carney, Jr. ..... E04B 2/16 52/564
6,578,338 B1 * 6/2003 Nanayakkara ..... E04B 2/14 52/603
8,266,855 B1 * 9/2012 Altararwah ..... E04B 2/18 52/286
8,671,640 B1 * 3/2014 Thomas ..... E04B 2/18 52/607
9,194,125 B1 * 11/2015 Romanenko ..... E04B 1/043
10,907,350 B1 * 2/2021 Shillingburg ..... E04C 1/395
2002/0019465 A1 2/2002 Li et al.
2003/0029123 A1 * 2/2003 Pignataro ..... E04B 2/02 52/712
2007/0006542 A1 * 1/2007 Duke ..... F41H 5/04 52/561
2008/0060313 A1 * 3/2008 Edwards ..... E04B 2/18 52/606
2008/0110124 A1 * 5/2008 Buse ..... E04B 2/06 52/562
2009/0313933 A1 * 12/2009 Clear ..... E04B 2/24 52/439
2011/0041436 A1 * 2/2011 Sigurdson ..... E04B 1/04 52/585.1
2012/0090260 A1 * 4/2012 Muirhead ..... E04B 2/20 52/745.19
2012/0192506 A1 * 8/2012 King ..... E04B 1/043 52/125.4
2013/0167469 A1 * 7/2013 Coccagna ..... E04C 5/168 52/677
2014/0090325 A1 * 4/2014 Maeers ..... E04C 1/00 52/503
2016/0002918 A1 * 1/2016 Conturo ..... E04B 2/48 52/604
2016/0002928 A1 * 1/2016 Mosch ..... E04B 2/10 428/597
2016/0076246 A1 * 3/2016 Romanenko ..... E04C 1/397 52/601
2016/0107332 A1 * 4/2016 Grivetti ..... B28B 3/2636 425/375
2016/0319540 A1 * 11/2016 Marsh ..... E04B 7/00
2017/0022710 A1 * 1/2017 Riccobene ..... E02D 29/0266
2017/0365365 A1 * 12/2017 White ..... H05K 9/00
2018/0223524 A1 * 8/2018 Mohamed ..... E04C 1/397
2018/0245339 A1 * 8/2018 Hon ..... E04C 1/397
2018/0298608 A1 * 10/2018 Van Cauter ..... E04B 2/54
2018/0332981 A1 * 11/2018 Kumar ..... A47G 1/08
2018/0347188 A1 * 12/2018 Parks ..... E04B 2/18
2019/0127976 A1 * 5/2019 Donnelly ..... E02B 3/10
2019/0234041 A1 * 8/2019 Riccobene ..... E02D 29/025
2020/0001520 A1 * 1/2020 Lootens ..... B29C 64/386
2020/0165822 A1 * 5/2020 Kreizinger ..... B28B 13/0225
2020/0269463 A1 * 8/2020 Mayer ..... E04B 1/35
2020/0282593 A1 * 9/2020 Le Roux ..... B28B 1/001
2020/0362558 A1 * 11/2020 Oberhouse ..... E04G 23/0218
2020/0385984 A1 * 12/2020 Raffion ..... E04C 1/40
2021/0047832 A1 * 2/2021 Giles ..... E04C 5/163
2021/0076824 A1 * 3/2021 Hsu ..... E04C 1/00
2021/0238846 A1 * 8/2021 Zhang ..... E04B 2/32
2021/0252825 A1 * 8/2021 TenHouten ..... B32B 3/06
2021/0310244 A1 * 10/2021 Phelan ..... E04C 1/39
2021/0355031 A1 * 11/2021 Chung ..... C04B 24/2652

FOREIGN PATENT DOCUMENTS

EP 1903014 A1 3/2008
EP 1958926 A1 8/2008

(56) References Cited

FOREIGN PATENT DOCUMENTS

| | | | |
|---|---|---|---|
| FR | 2918396 | A1 | 1/2009 |
| WO | 2014/094183 | A1 | 6/2014 |

OTHER PUBLICATIONS

Le et al. "Mix design and fresh properties for high-performance printing concrete" Materials and Structures, Springer International Publishing AG, vol. 45, No. 8, Jan. 19, 2012, pp. 1221-1232, XP035082641.

Airey et al. "Multidisciplinary Design Project Mega scale 3D Printing." University of Surrey, Jan. 2012, XP055219579.

Nov. 17, 2017 Written Opinion issued in International Patent Application No. PCT/IB2017/054402.

* cited by examiner

FIG.8
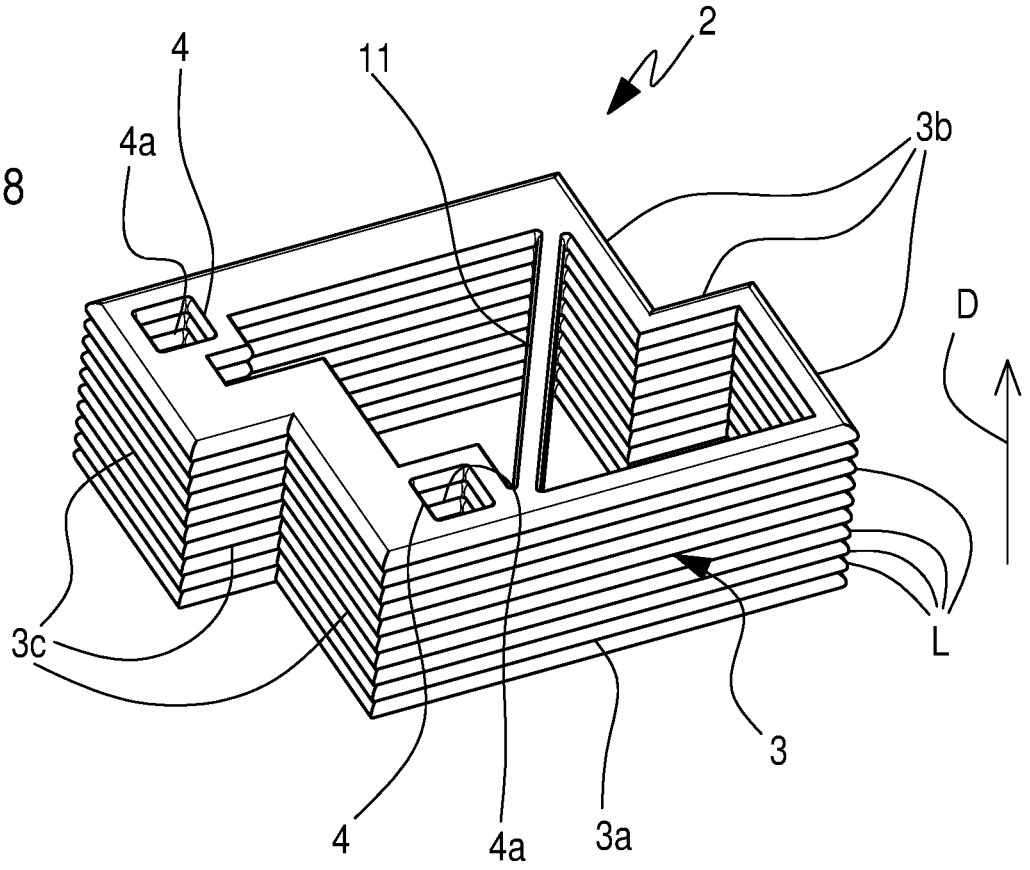
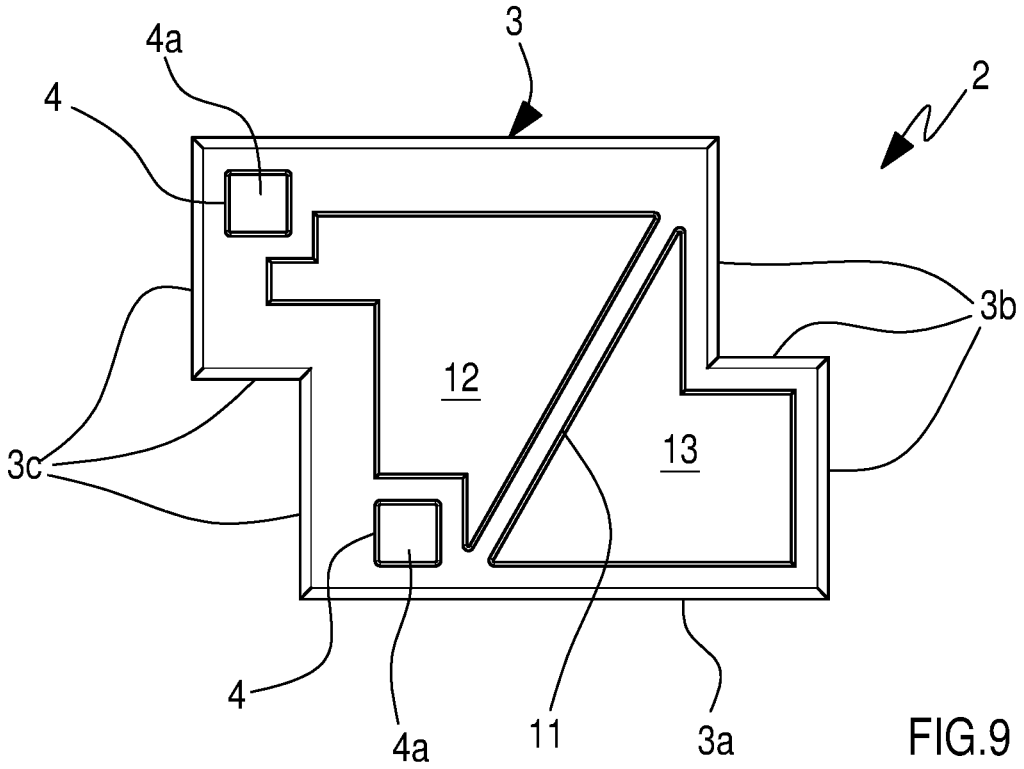
FIG.9

FIG.10
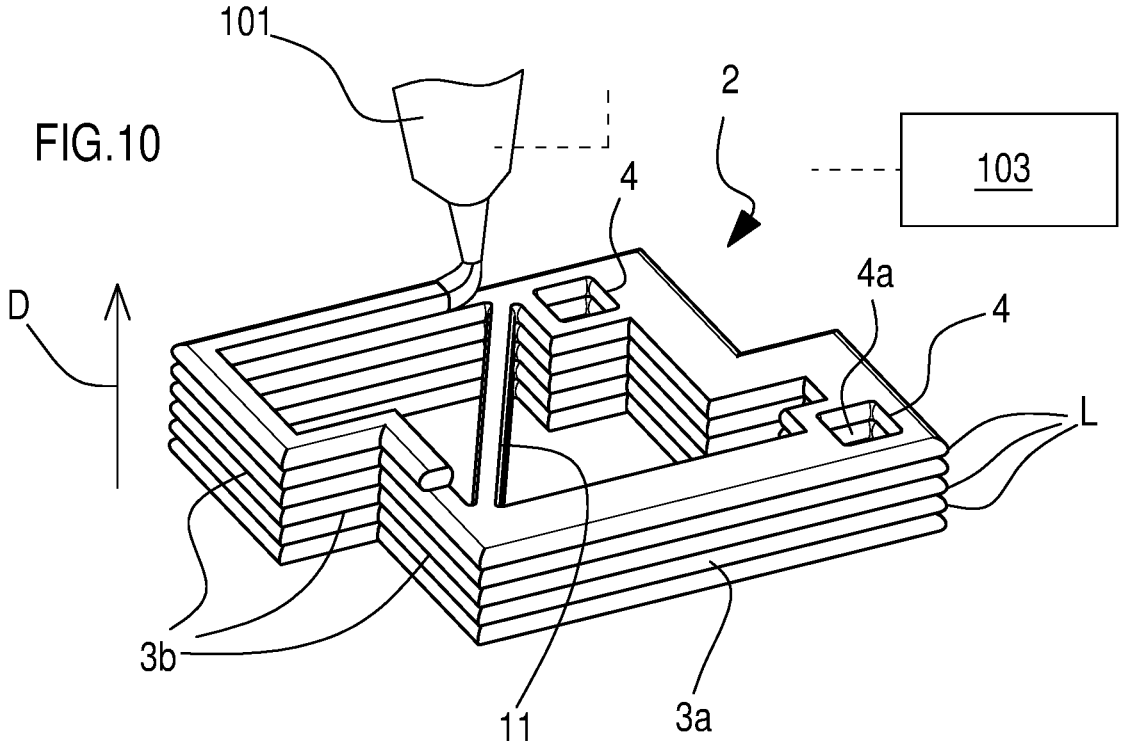
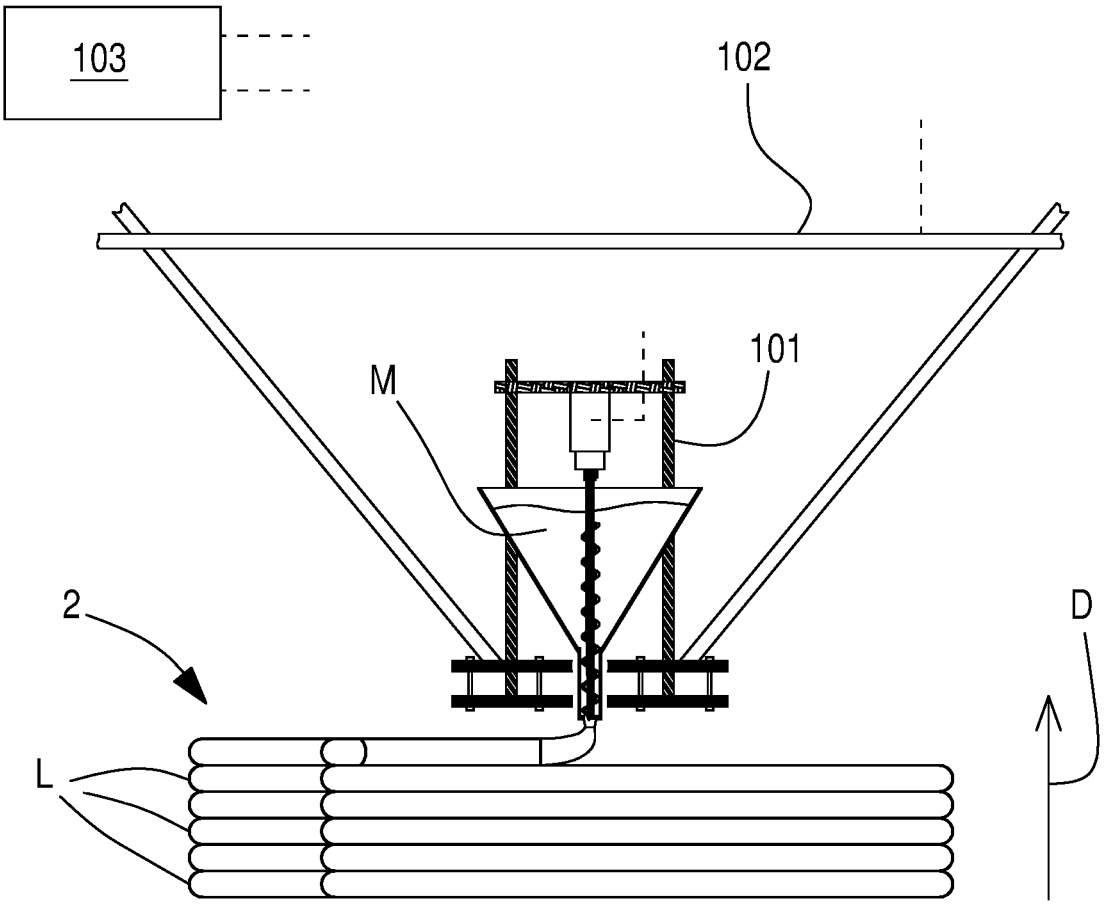
FIG.11

STRUCTURE OF REINFORCED CEMENTITIOUS MATERIAL AND PROCESS OF MAKING THE SAME STRUCTURE BY A THREE-DIMENSIONAL PRINTING PROCESS

FIELD OF THE INVENTION

The object of the present invention is a structure of reinforced cementitious material and a process of making the same by a three-dimensional printing process. The invention can be advantageously applied in the architectural, design and building fields, for example for erecting buildings and also in the construction engineering field.

BACKGROUND OF THE INVENTION

Nowadays, making components by 3D printers using the Additive Manufacturing technology has a blooming development and is substantially impacting different industrial manufacturing fields. The 3D printing process enables to deposit layers of a material on a base of a three-dimensional pattern for physically making this latter. With reference to the present description, the construction, building and design fields are particularly interesting. Recently, the Additive Manufacturing technology is used by 3D printers for supplying inorganic "pastes" (mainly clays) as printing material for making typically small artifacts having non-structural functions. The artifacts obtainable by the Additive Manufacturing technology are not useable as structural elements in the building and construction fields. Until now, the components of cementitious material used in the construction and building fields are made by two different technologies: the subtractive technology and the formative technology. The subtractive technology provides to take away a cementitious material from a rough preform in order to obtain a finished product. On the contrary, the formative technology provides to pour a cementitious material at the liquid (green) state inside adapted moulds (casings) wherein the material solidifies for defining the finished product: at the end of the solidifying step, the finished product is then extracted from the mould. These known technologies, while being widely used for making components and structural elements of cementitious materials, exhibits substantial limitations. De facto, such technologies do not enable to easily and economically make components different from each other by shape and size. Indeed, it is noted that when there is the need of making by the above described processes, different types of blocks of concrete, it will be necessary to differentiate—in case of the subtractive technology—the process of removing the material for each block, while—in case of the formative technology—it will be necessary to provide a different mould for each component; in this way, the actions at a processing level, necessary for making different types of blocks, will substantially increase the times and therefore the costs for manufacturing these latter. Moreover, it is noted that manufacturing blocks different from each other entails, with the subtractive technology, an additional step of processing the rough blocks which, besides increasing the processing times, impacts on the cost and the amount of scraps. Instead, the formative technology requires a greater investment in term of equipment; each type of blocks will require a dedicated mould. Moreover, it is noted that the known above described technologies (subtractive and formative for elements of cementitious material) do not enable to easily and economically make components of cementitious material exhibiting complicated shapes, for example defined by arcuate portions with varying cross-section.

Therefore, the object of the present invention consists of substantially solving at least one of the inconveniences and/or limitations of the previous solutions.

A first object of the present invention consists of providing a structure of reinforced cementitious material exhibiting excellent mechanical properties and, at the same time, easily and quickly manufacturable. Particularly, it is an object of the present invention to provide a structure of reinforced cementitious material exhibiting a suitable shape and size and adapted to ensure optimal structural characteristics. Moreover, it is an object of the present invention to provide a structure of reinforced cementitious material which exhibits a flexible use and which can be employed for making different types of constructions and structural elements. Then, it is an object of the present invention to provide a structure of reinforced cementitious material manufacturable with a limited amount of material, and capable anyway of maintaining excellent properties of mechanical strength to stresses. Moreover, it is an object of the present invention to provide a structure of reinforced cementitious material obtainable with limited manufacturing costs.

Then, it is an object of the present invention to provide a fast and highly versatile process of making a structure of reinforced cementitious material which therefore can reduce at the minimum the manufacturing costs. A further object of the present invention consists of providing a cementitious composition adapted to be 3D-printed, particularly a cementitious composition being capable of being conveyed to the supplying head 101 of the 3D printer and to be extruded or pumped by the same, and therefore printable, through the supplying head.

Moreover, a further object of the present invention consists of providing a cementitious composition wherein the layers thereof, after being printed, show the capability of remaining separated from each other, and of supporting the weight of the following layers deposited by the 3D printing process, of having a good setting and hardening kinetics, and compressive strength. Lastly, a further object of the present invention consists of providing a cementitious composition enabling to make shapes which are both structurally efficient and characterized by using a low quantity of the cementitious material. These and other objects, which will better appear in the following description, are substantially met by a structure of reinforced cementitious material and a process of making this latter according to what is disclosed in one or more of the attached claims, and/or of following aspects, considered alone or in any combination with each other or in a combination with any of the attached claims and/or in a combination of any of the further aspects or characteristics described in the following.

SUMMARY

The aspects of the invention are described in the following.

In a 1st aspect, it is provided a structure (1) of reinforced cementitious material according to the independent claim 6.

In a 2nd aspect according to the preceding aspect, the connecting element (8) comprises at least one reinforcing bar, optionally of metal material, extending along a longitudinal development direction between a first and second end portions (8*a*, 8*b*), said connecting element (8) comprising—at the first end portion (8*a*)—a first engagement portion (9) emerging from the reinforcing bar transversally to the longitudinal development direction of the same, and engaged inside the cavity (4*a*) of the hooking portion (4) of the first module (2), said connecting element (8) further comprising—at the second end portion (8*b*)—a second engagement portion (10) emerging from the reinforcing bar transversally to the longitudinal development direction of the same and engaged inside the cavity (7*a*) of the hooking portion (7) of the second module (2).

In a 3rd aspect according to the preceding aspect, the first and second engagement portions (9, 10) of the connecting element (8) are distinct and removably associable to the reinforcing bar.

In a 4th aspect according to any one of the preceding aspects, each module exhibits, along the stratification direction (D), a substantially constant cross-section for defining substantially a profile.

In a 5th aspect according to any one of the preceding aspects, the lateral wall (3) of the first module (2) defines a closed outer perimeter, particularly having a polygonal shape.

In a 6th aspect according to any one of the preceding aspects, the lateral wall (6) of the second module (5) defines a closed outer perimeter, particularly having a polygonal shape.

In a 7th aspect according to the aspect 5 or 6, the hooking portion (4) of said first module (2) is defined inside said closed outer perimeter, optionally said hooking portion (4) extends for all a development of the first module (2) along the stratification direction (D).

In an 8th aspect according to the aspect 6 or 7, the hooking portion (7) of said second module (5) is defined inside said closed outer perimeter, optionally said hooking portion (7) extends for all a development of the second module (7) along the stratification direction (D).

In a 9th aspect according to any one of the preceding aspects, the first module is hollow and exhibits a closed outer perimeter, the first module comprising, inside the closed outer perimeter, a reinforcing portion (11) extending inside the closed outer perimeter between two sides substantially opposite to each other.

In a 10th aspect according to the preceding aspect, the reinforcing portion (11) of the first module (2) extends along the stratification direction (D) and defines, cooperatively with the lateral wall (3) of the first module (2), at least one first and one second through seats (12, 13).

In an 11th aspect according to any one of the preceding aspects, the second module is hollow and exhibits a closed outer perimeter, the second module comprising inside the closed outer perimeter, a reinforcing portion (14) which extends inside the closed outer perimeter between two sides substantially opposite to each other.

In a 12th aspect according to a preceding aspect, the reinforcing portion (14) of the second module (5) extends along the stratification direction (D) and defines, cooperatively with the lateral wall (6) of the second module (5), at least one first and one second through seats (15, 16).

In a 13th aspect according to any one of the preceding aspects, the second module (5) comprises a further reciprocal coupling surface (6*c*) opposite to the reciprocal coupling surface (6*b*) of the second module (5) itself, said plurality of modules comprises at least one third module (18) comprising at least one lateral wall (19) delimited by an outer surface (19*a*) and extending along the stratification direction (D), at least part of the outer surface (19*a*) of the third module (18) defining a reciprocal coupling surface (19*b*) countershaped to the further reciprocal coupling surface (6*c*) of the second module (5), said third module (18) further comprising at least one hooking portion (20) defining at least one cavity (20*a*) extending at least partially along the stratification direction (D), and wherein the structure (1) further comprises a connecting element (24) engaged, on one side, inside the cavity (7*a*) of the hooking portion (7) of the second module (5) and, on the other side, inside the cavity (20*a*) of the hooking portion of the third module (18), said connecting element (8) stably constraining the second module and third module (5, 18) and being configured for holding these latter in contact with each other.

In a 14th aspect according to the preceding aspect, the connecting element (24) of the second and third modules comprises at least one reinforcing bar, optionally of metal material, extending along a longitudinal development direction between a first and second end portions (24*a*, 24*b*), said connecting element (24) of the second and third modules comprising—at the first end portion (24*a*)—a first engagement portion (25) emerging from the reinforcing bar transversally to the longitudinal development direction of the same and engaged inside the cavity (4*a*) of the hooking portion (4) of the second module (5), said connecting element (8) of the second and third modules further comprising—at the second end portion (24*b*)—a second engagement portion (26) emerging from the reinforcing bar transversally to the longitudinal development direction of the same and engaged inside the cavity (20*a*) of the hooking portion (20) of the third module (18).

In a 15th aspect according to the preceding aspect, the first and second engagement portions of the connecting element (24) of the second and third modules are distinct and removably associable to the reinforcing bar.

In a 16th aspect according to any one of the aspects from 13 to 15, the third module exhibits, along the stratification direction (D), a substantially constant cross-section for substantially defining a profile.

In a 17th aspect according to any one of the aspects from 13 to 16, the lateral wall (19) of the third module (18) defines a closed outer perimeter, particularly having a polygonal shape.

In an 18th aspect according to the preceding aspect, the hooking portion (20) of the third module (18) is defined inside said closed outer perimeter, optionally said hooking portion (20) extends for all a development of the third module (18) along the stratification direction (D).

In a 19th aspect according to any one of the aspects from 13 to 18, the third module (18) is hollow and exhibits a closed outer perimeter, the third module (18) exhibits, inside the closed outer perimeter, a reinforcing portion (21) extending inside the closed outer perimeter between two sides of said perimeter, substantially opposite to each other.

In a 20th aspect according to the preceding aspect, the reinforcing portion (21) extends along the stratification direction (D) of the third module (18) and defines, cooperatively with the lateral wall (19) of the third module (18), at least one first and one second through seats (22, 23).

In a 21st aspect according to any one of the aspects from 13 to 20, the structure comprises a connecting element (27) engaged, on one side, inside the cavity (4*a*) of the hooking portion (4) of the first module (2) and, on the other side, inside the cavity (20*a*) of the hooking portion (20) of the third module (28), said connecting element (27) stably constraining the first module and third module (2, 18).

In a 22nd aspect, it is provided a process of making a structure of reinforced cementitious material according to any one of the preceding aspects.

In a 23rd aspect according to the preceding aspect, the process is according to claim 1.

In a 24th aspect according to the preceding aspect, the connecting element (8) comprises at least one reinforcing bar, optionally of metal material, extending along a longitudinal development direction between a first and second end portions (8*a*, 8*b*), said connecting element (8) comprising—at the first end portion (8*a*)—a first engagement portion (9) emerging from the reinforcing bar transversally to the longitudinal development direction of the same, said connecting element (8) further comprising—at the second end portion (8*b*)—a second engagement portion (10) emerging from the reinforcing bar transversally to the longitudinal development direction of the same, and wherein the step of engaging the connecting element (8) with the first and second modules (2, 5) comprises at least the following sub-steps:

stably engaging the first engagement portion (9) inside the cavity (4*a*) of the hooking portion (4) of the first module (2), stably engaging the second engagement portion (10) inside the cavity (7*a*) of the hooking portion (7) of the second module (5).

In a 25th aspect according to the preceding aspect, the step of engaging the first engagement portion (9) with the first module (2) comprises at least the following sub-steps:

inserting the first engagement portion (9) inside the cavity (4*a*) of the hooking portion (4) of the first module (2), filling at least partially the cavity (4*a*) of the hooking portion (4) of the first module (2) with a cementitious material at least partially at a liquid state so that this latter can contact at least part of said first engagement portion (9), constraining, by hardening the cementitious material inside the cavity (4*a*) of the first module (2), said first engagement portion (9), and wherein the step of engaging the second engagement portion (10) with the second module (5) comprises at least the following sub-steps:

inserting the second engagement portion (10) inside the cavity (7*a*) of the hooking portion (7) of the second module (5), filling at least partially the cavity (7*a*) of the hooking portion (7) of the second module (5) with a cementitious material at least partially at a liquid state so that this latter can contact at least part of said second engagement portion (10), constraining, by hardening the cementitious material inside the cavity (7*a*) of the second module (5), said second engagement portion (10).

In a 26th aspect according to the aspect 24 or 25, the first and second engagement portions of the connecting element (8) are distinct and removably associable to the reinforcing bar, the process comprises the steps of engaging the first and second engagement portions (9, 10) respectively in the first and second modules and after a step of constraining the reinforcing bar to said first and second engagement portions (9, 10).

In a 27th aspect according to any one of the aspects from 22 to 26, the process comprises—after the step of engaging the connecting element with the first and second modules (2, 5)—a further step of fixing the first and second modules which provides at least the following sub-steps:

providing between the reciprocal coupling surfaces of the first and second modules, a predetermined quantity of cementitious material at least partially at a liquid state, further constraining, by hardening said cementitious material disposed between the reciprocal coupling surfaces, said first and second modules.

In a 28th aspect according to any one of the aspects from 23 to 27, the step of depositing, by a 3D printing process, the plurality of layers (L) of cementitious material one on the other along the stratification direction (D), comprises a step of overlapping layers (L) exhibiting substantially the same shape and size, each module exhibiting, along the stratification direction (D), a substantially constant cross-section for essentially defining a profile.

In a 29th aspect according to any one of the aspects from 22 to 28, the lateral wall (3) of the first module (2) defines a closed outer perimeter, particularly having a polygonal shape.

In a 30th aspect according to any one of the aspects from 22 to 29, the lateral wall (6) of the second module (5) defines a closed outer perimeter, particularly having a polygonal shape.

In a 31st aspect according to the aspect 29 or 30, the hooking portion (4) of said first module (2) being defined inside said closed outer perimeter, optionally said hooking portion (4) extends for all a development of the first module (2) along the stratification direction (D).

In a 32nd aspect according to the aspect 30 or 31, the hooking portion (7) of said second module (5) being defined inside said closed outer perimeter, optionally said hooking portion (7) extends for all a development of the second module (7) along the stratification direction (D).

In a 33rd aspect according to any one of the aspects from 29 to 32, the step of depositing the cementitious material by the 3D printing, is adapted to define a first hollow module (2) with a closed outer perimeter, said depositing step further comprising a step of defining, inside the closed outer perimeter of the first module (2), a reinforcing portion (11), said reinforcing portion (11) extending inside the closed outer perimeter of the first module between two sides of said perimeter, substantially opposite to each other.

In a 34th aspect according to the preceding aspect, the reinforcing portion (11) extends along the stratification direction (D) of the first module (2) and defines, cooperatively with the lateral wall (3) of the first module (2), at least one first and one second through seats (12, 13).

In a 35th aspect according to any one of the aspects from 29 to 34, the step of depositing the cementitious material by the 3D printing, is adapted to define a second hollow module (5) having a closed outer perimeter, said depositing step further comprising a step of defining, inside the closed outer perimeter of the second module (5), a reinforcing portion (14), said reinforcing portion (14) extending inside the closed outer perimeter of the second module between two sides of said perimeter substantially opposite to each other.

In a 36th aspect according to the preceding aspect, the reinforcing portion (14) of the second module (5) extends along the stratification direction (D) of the second module itself and defines, cooperatively with the lateral wall (6) of the second module (5), at least one first and one second through seats (15, 16).

In a 37th aspect according to any one of the aspects from 22 to 36, the second module (5) comprises a further reciprocal coupling surface (6*c*) opposite to the reciprocal coupling surface (6*b*) of the second module (5) itself, said plurality of modules comprises at least one third module (18) comprising at least a lateral wall (19) delimited by an outer surface (19*a*) and extending along the stratification direction (D), at least part of the outer surface (19*a*) of the third module (18) defining a reciprocal coupling surface (19*b*) countershaped to the further reciprocal coupling surface (6*c*) of the second module (5), said third module (18) further comprising at least one hooking portion (20) defining at least one cavity (20*a*) extending at least partially along the stratification direction (D), said process further comprising the following steps:

bringing in contact the second and third modules (5, 18) so that the further reciprocal coupling surface (6*c*) of the second module (5) and the reciprocal coupling surface (19*b*) of the third module (18) abuts on each other, the third module (18) being opposite to the first module (2) with respect to the second module (5), after the step of contacting the second module (5) with the third module (18), engaging at least one connecting element (24), on one side, inside the cavity (7*a*) of the hooking portion (7) of the second module (5) and, on the other side, inside the cavity (20*a*) of the hooking portion (20) of the third module (18), said connecting element (24) stably constraining the second module and third module (5, 18), and being configured for holding these latter in contact with each other.

In a 38th aspect according to the preceding aspect, the connecting element (24) of the second and third modules comprises at least one reinforcing bar, optionally of a metal material, extending along a longitudinal development direction between a first and second end portions (24*a*, 24*b*), said connecting element (24) comprising—at the first end portion (24*a*)—a first engagement portion (25) emerging from the reinforcing bar transversally to the longitudinal development direction of the same, said connecting element (24) further comprising—at the second end portion (24*b*)—a second engagement portion (26) emerging from the reinforcing bar transversally to the longitudinal development direction of the same, the step of engaging the connecting element (24) with the second and third modules (5, 18) comprises at least the following sub-steps:

stably engaging the first engagement portion (25) inside the cavity (7*a*) of the hooking portion (7) of the second module (5), stably engaging the second engagement portion (26) inside the cavity (20*a*) of the hooking portion (20) of the third module (18).

In a 39th aspect according to the preceding aspect, the step of engaging the first engagement portion (25) with the second module (5) comprises at least the following sub-steps:

inserting the first engagement portion (25) inside the cavity (7*a*) of the hooking portion (7) of the second module (5), filling at least partially the cavity (7*a*) of the hooking portion (7) of the second module (5) with a cementitious material at least partially at a liquid state so that this latter can contact at least part of said first engagement portion (25), constraining, by hardening the cementitious material inside the cavity (7*a*) of the second module (5), said first engagement portion (25), and wherein the step of engaging the second engagement portion (26) with the third module (18) comprises at least the following sub-steps:

inserting the second engagement portion (26) inside the cavity (20*a*) of the hooking portion (20) of the third module (18), filling at least partially the cavity (20*a*) of the hooking portion (20) of the third module (18) with a cementitious material at least partially at a liquid state so that this latter can contact at least part of said second engagement portion (26), constraining, by hardening the cementitious material inside the cavity (20*a*) of the third module (18), said second engagement portion (26).

In a 40th aspect according to the aspect 38 or 39, the first and second engagement portions of the connecting element (24) of the second and third modules, are distinct and removably associable to the reinforcing bar, the process comprises the steps of engaging said first and second engagement portions (25, 26) respectively in the second and third modules and after a step of constraining the reinforcing bar to said first and second engagement portions (25, 26).

In a 41st aspect according to any one of the aspects from 22 to 40, the process comprises—after the step of engaging the connecting element with the second and third modules (5, 18)—a step of further fixing the second and third modules which provides at least the following sub-steps:

providing between the further reciprocal coupling surface of the second module and the reciprocal coupling surface of the third module, a predetermined quantity of a cementitious material at least partially at liquid state, further constraining, by hardening said cementitious material disposed between said reciprocal coupling surfaces, said second and third modules.

In a 42nd aspect according to any one of the aspects from 22 to 41, the step of depositing, by a 3D printing process, the plurality of layers (L) of cementitious material, one on the other along the stratification direction (D) comprises a step of overlapping layers (L) exhibiting substantially the same shape and size, each module exhibiting, along the stratification direction (D), a substantially constant cross-section for essentially defining a profile.

In a 43rd aspect according to any one of the aspects from 37 to 42, the lateral wall (19) of the third wall (18) defines a closed outer perimeter, particularly having a polygonal shape.

In a 44th aspect according to the preceding aspect, the hooking portion (20) of the third module (18) is defined inside said closed outer perimeter, optionally said hooking portion (20) extends for all a development of the third module (18) along the stratification direction (D).

In a 45th aspect according to any one of the aspects from 37 to 44, the step of depositing the cementitious material by the 3D printing, is adapted to define a third hollow module (18) having a closed outer perimeter, said depositing step further comprising a step of defining, inside the closed outer perimeter of the third module (18), a reinforcing portion (21), said reinforcing portion (21) extending inside the closed outer perimeter of the third module between two sides of said perimeter, substantially opposite to each other.

In a 46th aspect according to the preceding aspect, the reinforcing portion (21) extends along a stratification direction (D) of the third module (18) and defines, cooperatively with the lateral wall (19) of the third module (18), at least one first and one second through seats (22, 23).

In a 47 aspect according to any one of the aspects from 37 to 46, the process further comprises the step of engaging at least one connecting element (27), on one side, inside the cavity (4*a*) of the hooking portion (4) of the first module (2) and, on the other side, inside the cavity (20*a*) of the hooking portion (20) of the third module (18), said connecting element (27) stably constraining the first module and third module (2, 18).

In a 48th aspect, it is provided a cementitious composition (M) comprising:

(i) from 15 to 30% by weight of cement with respect to the total weight of the composition, (ii) from 60 to 80% by weight of at least one inert aggregate, alone or in a mixture with one or more other inert aggregates, with respect to the total weight of the composition, (iii) from 0.02 to 0.75% by weight of at least one polymeric fiber, alone or in a mixture with one or more other polymeric fibers, with respect to the total weight of the composition, (iv) from 0.03 to 0.1% by weight of at least one superfluidifying agent, alone or in mixture with one or more other superfluidifying agents, with respect to the total weight of the composition, and (v) water in a quantity sufficient to reach 100% by weight of the composition, optionally, it can be present:

(vi) from 0.1 to 2.5% by weight of at least one viscosity modifying agent with respect to the total weight of the composition, wherein:

the weight ratio between water and cement is comprised between 0.3 and 0.45 or the ratio between water and the equivalent cement is comprised between 0.29 and 0.49; and the maximum diameter of the at least one inert aggregate is less than 12.5 mm.

In a 49th aspect according to the aspect 48, the cement (i) is selected among those belonging to the types I, II, III, IV and V established by the standard EN 197-1, incorporated at a national level by the standard UNI EN 197/1; preferably among those belonging to the types I, II, III, IV and V and having strength classes 42,5R and 52,5R according to the standard UNI EN 197/1; more preferably among those belonging to the classes CEM II/A-L (or A-LL) 42,5R and CEM II/A-L (or A-LL) 52,5R; still more preferably among those belonging to the class CEM II/A-L (or A-LL) 42,5R according to the standard UNI EN 197/1;

and/or the at least one inert aggregate (ii) is selected among fine aggregates, fillers and mixtures thereof, preferably the filler is selected among quartz sand, siliceous sand and calcareous filler; preferably the inert aggregate comprises a mixture of sand and quartz sand and/or calcareous filler;

and/or the at least one polymeric fiber (iii) is selected among the polyolefinic fibers, preferably polypropylene (PP); polyvinyl alcohol (PVA); polyesters; aliphatic polyamides (Nylon); and mixtures thereof; preferably, is a polypropylene (PP) fiber;

and/or the at least one superfluidifying agent (iv) is selected among polymers optionally modified polycarboxylic polyethers, naphthalene sulfonic polyethers, acrylic polyethers, glycol propylenes, and mixtures thereof; preferably, the polymer is a modified polycarboxylic polyether.

In a 50th aspect according to any one of the aspects 48 or 49, the cement (i) has a maximum diameter of the particles less than or equal to 100 microns, preferably less than 50 microns, still more preferably less than 30 microns; and/or the sand has a maximum diameter less than 10 mm, still more preferably less than 6 mm, still more preferably less than 4 mm, according to the standard UNI 8520-1 for the compliance and the standard UNI 2332 for determining the granulometric distribution; and/or the filler, preferably quartz sand or calcareous filler, has a maximum diameter less than 0.25 mm, preferably less than 0.125 mm, still more preferably less than 0.063 mm, according to the standard UNI 8520-1 for the compliance and the standard UNI 2332 for determining the granulometric distribution; and/or the weight ratio between water and cement is comprised between 0.33 and 0.40.

In a 51st aspect according to any one of the aspects from 48 to 50, the weight percentage of cement is preferably greater than 18%, more preferably greater than 21%; and/or is preferably less than 27%, more preferably is less than 25%; and/or is preferably comprised between 18% and 27%, more preferably is comprised between 21% and 25% with respect to the total weight of the composition; and/or the weight percentage of at least one inert aggregate, alone or in mixture with one or more other inert aggregates, is preferably greater than 63%, more preferably greater than 65%; and/or is preferably less than 79%, more preferably is less than 77%; and/or is preferably comprised between 63% and 79%, more preferably is comprised between 65% and 77% with respect to the total weight of the composition; and/or the weight percentage of the at least one polymeric fiber, alone or in a mixture with one or more other polymeric fibers, is preferably greater than 0.025%, more preferably greater than 0.03%; and/or is preferably less than 0.6%, more preferably is less than 0.5%; and/or is preferably comprised between 0.025% and 0.6%, more preferably is comprised between 0.03% and 0.5% with respect to the total weight of the composition; and/or the weight percentage of the at least one superfluidifying agent, alone or in a mixture with one or more other superfluidifying agents, is preferably greater than 0.035%; and/or is preferably less than 0.05%; and/or is preferably comprised between 0.035% and 0.05% with respect to the total weight of the composition.

In a 52nd aspect according to any one of the aspects from 41 to 51, the mass percentage of the at least one superfluidifying agent, alone or in a mixture with one or more other fluidifying agents, is preferably greater than 0.02%, more preferably greater than 0.05%; and/or is preferably less than 0.15%, more preferably is less than 0.10%; and/or is preferably comprised between 0.02% and 0.15%, more preferably is comprised between 0.05% and 0.10% with respect to the total mass of the composition, and/or the mass percentage of the at least one superfluidifying agent, alone or in a mixture with one or more other fluidifying agents, is preferably greater than 0.1%, more preferably greater than 0.2%, still more preferably greater than 0.25%; and/or less than 0.65%, more preferably less than 0.5%, still more preferably less than 0.40%; and/or comprised between 0.1% and 0.65%, more preferably is comprised between 0.2% and 0.5%, still more preferably is comprised between 0.25% and 0.40% with respect to the total mass of the cement.

In a 53rd aspect according to any one of the aspects from 48 to 52, the composition comprises:

(i) from 15 to 30% by weight of cement with respect to the total weight of the composition, selected among those belonging to the types I, II, III, IV and V, and having strength classes 42,5R and 52,5R according to the standard UNI EN 197/1;

(ii) from 60 to 80% by weight of at least one inert aggregate, alone or in a mixture with one or more other inert aggregates, with respect to the total weight of the composition, comprising sand and quartz sand or a calcareous filler;

(iii) from 0.02 to 0.75% wt. of at least one polymeric fiber, alone or in a mixture with one or more other polymeric fibers, with respect to the total weight of the composition, selected among the polyolefinic fibers, preferably polypropylene (PP); polyvinyl alcohol (PVA); polyesters; and aliphatic polyamides (Nylon);

(iv) from 0.03 to 0.1% wt. of at least one superfluidifying agent, alone or in a mixture with one or more other superfluidifying agents, with respect to the total weight of the composition, selected among polymers optionally modified polycarboxylic polyethers, naphthalene sulfonic polyethers, polyphosphonics polyethers, and acrylic polyethers.

In a 54th aspect according to any one of the aspects from 48 to 53, the composition comprises:

(i) from 18 to 27% wt. of cement with respect to the total weight of the composition, selected among those belonging to the types I, II, III, IV and V and having strength classes 42,5R and 52,5R according to the standard UNI EN 197/1;

(ii) from 63 to 79% wt. of at least one inert aggregate, alone or in a mixture with one or more other inert aggregates, with respect to the total weight of the composition, comprising sand and quartz sand or calcareous filler;

(iii) from 0.025 to 0.6% wt. of at least one polymeric fiber, alone or in a mixture with one or more other polymeric fibers, with respect to the total weight of the composition, selected among the polyolefinic fibers, preferably polypropylene (PP); polyvinyl alcohol (PVA); polyesters; and aliphatic polyamides (Nylon);

(iv) from 0.035 to 0.05% wt. of at least one superfluidifying agent, alone or in a mixture with one or more other superfluidifying agents, with respect to the total weight of the composition, selected among polymers optionally modified polycarboxylic, naphthalene sulfonic, polyphosphonics, and acrylic polyethers.

In a 55th aspect according to any one of the aspects from 48 to 54, the composition comprises:

(i) from 21 to 25% wt. of cement with respect to the total weight of the composition, selected among those belonging to the types I, II, III, IV and V and having strength classes 42,5R and 52,5R according to the standard UNI EN 197/1;

(ii) from 65 to 77% wt. of at least one inert aggregate, alone or in a mixture with one or more other inert aggregates, with respect to the total weight of the composition, comprising sand and quartz sand or calcareous filler;

(iii) from 0.03 to 0.5% wt. of at least one polymeric fiber, alone or in a mixture with one or more other polymeric fibers, with respect to the total weight of the composition, selected among polyolefinic fibers, preferably polypropylene (PP); polyvinyl alcohol (PVA); polyesters; and aliphatic polyamides (Nylon); more preferably polypropylene (PP);

(iv) from 0.035 to 0.05% wt. of at least one superfluidifying agent, alone or in a mixture with one or more other superfluidifying agents, with respect to the total weight of the composition, selected among polymers optionally modified polycarboxylic, naphthalene sulfonic, polyphosphonics, and acrylic polyethers.

In an independent 55th aspect it is provided a method of preparing the composition according to claim 1 comprising: a) mixing the at least one inert aggregate (i) with the cement (ii), b) adding water to the obtained mixture and mixing in order to form a slurry, c) adding to the obtained slurry the at least one polymeric fiber (iii) and mixing, d) adding the at least one fluidifying agent (iv) and mixing.

In a 56th aspect, it is provided a method of preparing the cementitious composition according to the aspect 48 of the invention, comprising:

a) mixing the at least one inert aggregate (i) with the cement (ii), b) adding water to the obtained mixture and mixing in order to form a slurry, c) adding the at least one polymeric fiber (iii) to the obtained slurry and mixing, d) adding the at least one fluidifying agent (iv) and mixing.

In a 50th aspect, it is provided an use of the cementitious composition according to the aspect 48 of the invention for 3D-printing modules/structures of reinforced cementitious material.

DESCRIPTION OF THE DRAWINGS

Some embodiments and some aspects of the invention will be described in the following with reference to the attached drawings, given only in an indicative and therefore non-limiting way, wherein:

FIGS. 8 and 9 are respectively a perspective view and a front view of a module of a structure of reinforced cementitious material according to the present invention;

FIGS. 10 and 11 schematically illustrate a step of forming a module of a structure of reinforced cementitious material according to the present invention;

Figure 17:
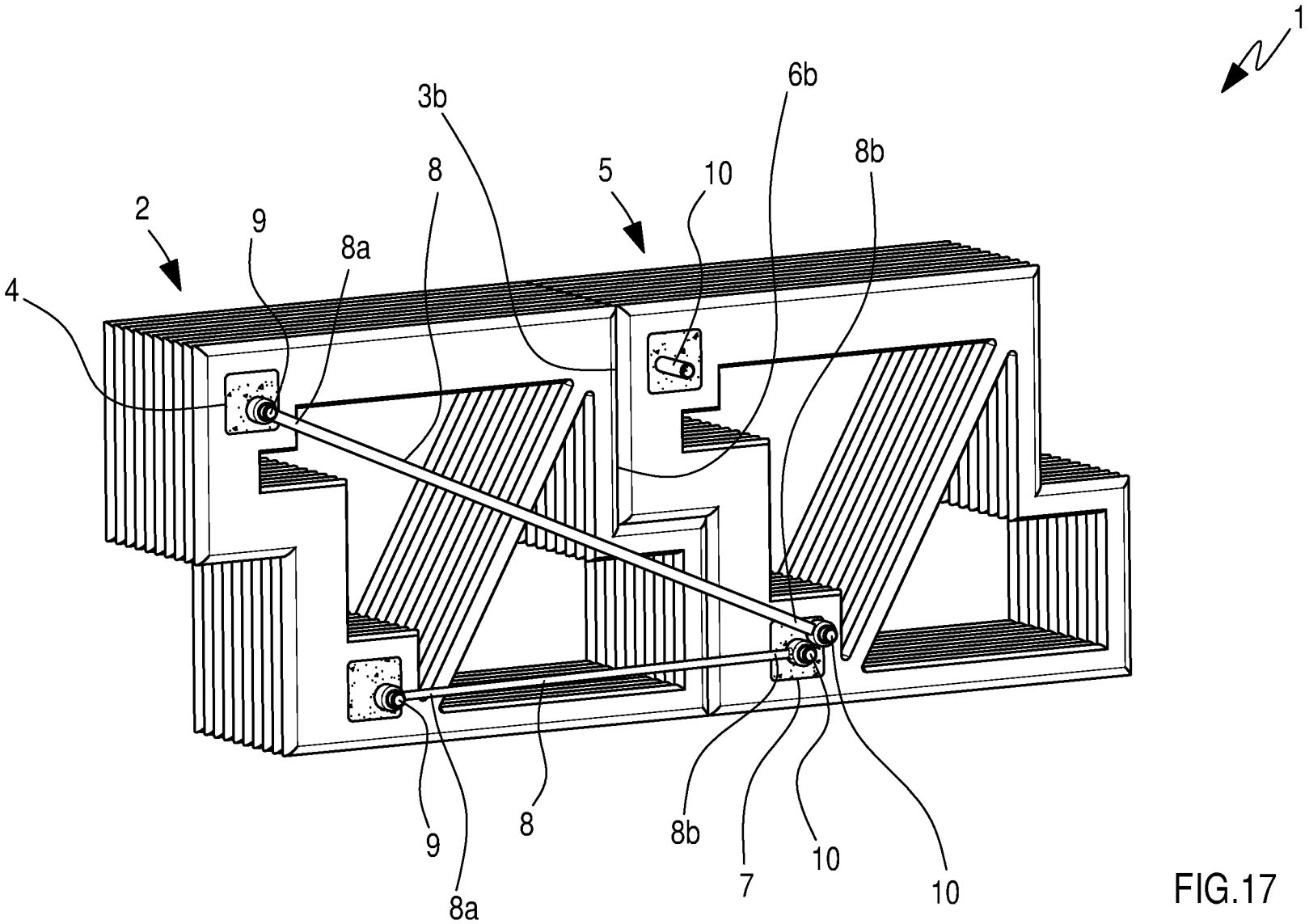
Figure 18:
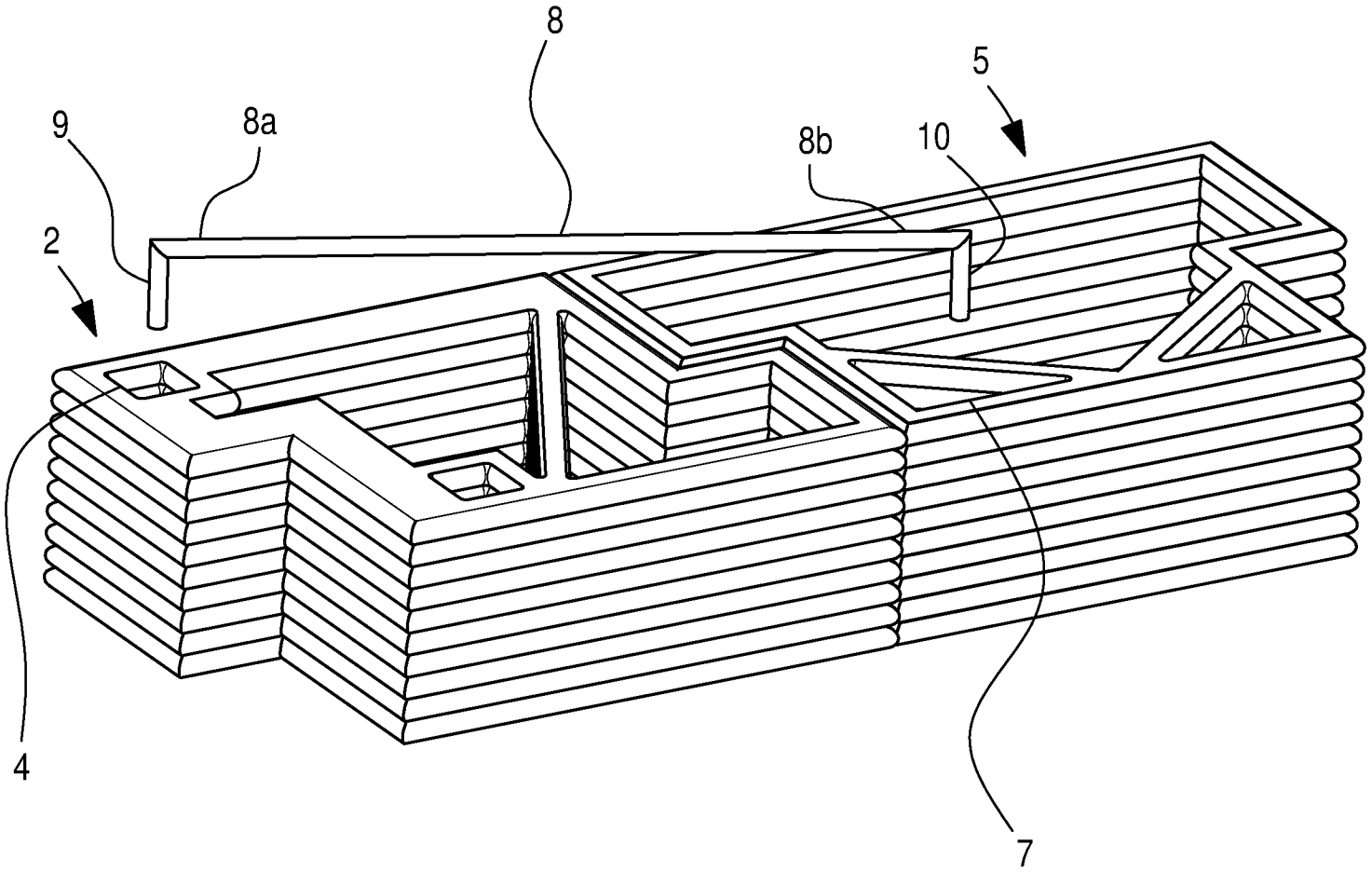
Figure 19:
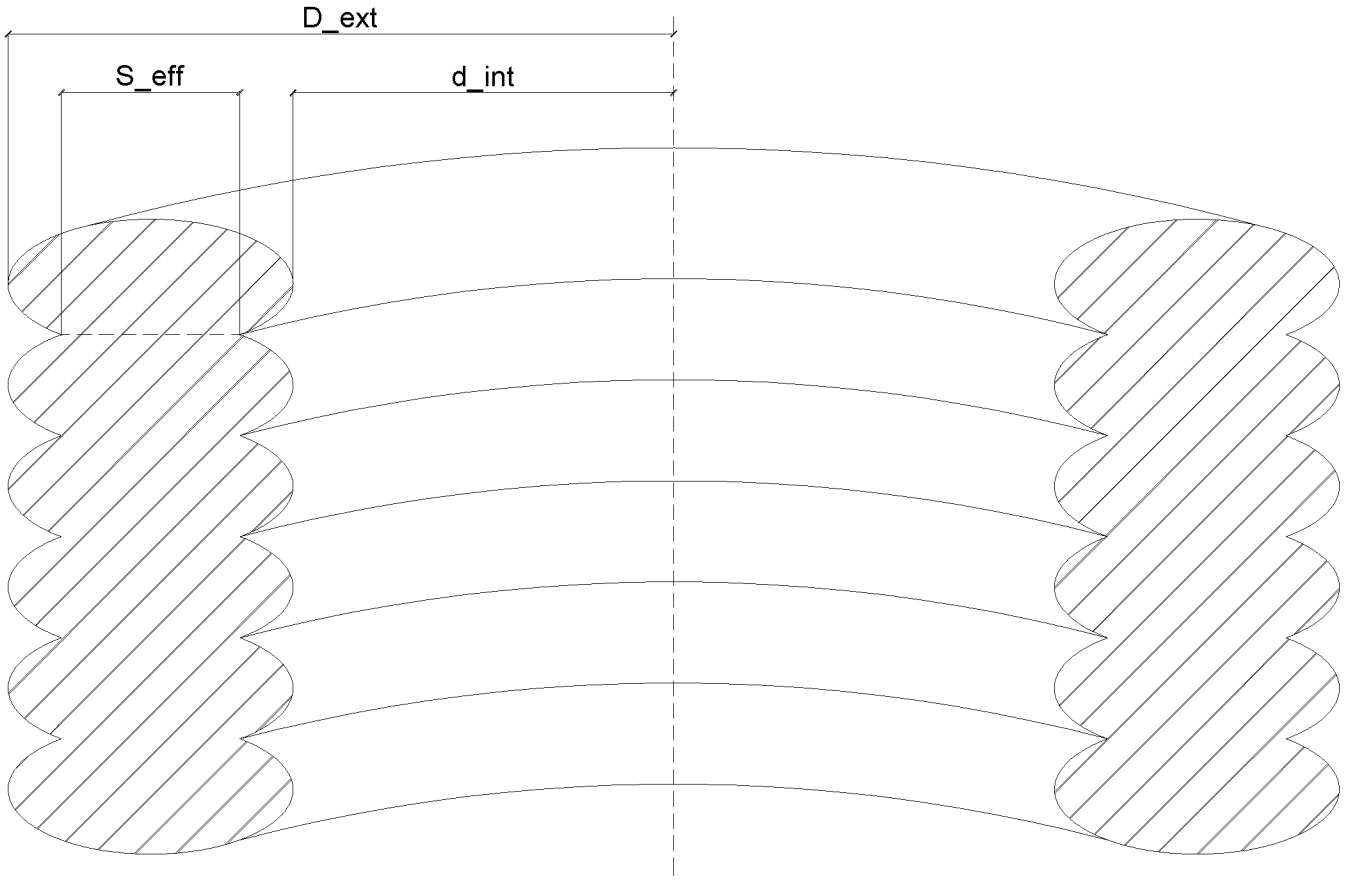

FIGS. from 12 to 16 schematically illustrate some steps of a process of making a structure of reinforced cementitious material according to the present invention;

FIG. 17 is a perspective view of a fourth embodiment a structure of reinforced cementitious material according to the present invention;

FIG. 18 is a perspective view of a step of an embodiment variant of a process of making a structure of reinforced cementitious material according to the present invention;

FIG. 19 is a cross-section view of a cylindrical specimen used in the example 4.

DETAILED DESCRIPTION

It is noted that in the present detailed description, corresponding parts illustrated in the different figures are indicated by the same numeral references. The figures could illustrate the object of the invention by not-to-scale representations; therefore, parts and components illustrated in the figures regarding the object of the invention could refer only to schematic representations.

The term "three-dimensional printing" or 3D printing means a process of making objects by a three-dimensional printer or 3D printer based on a material additive technology (known as Additive Manufacturing). The process provides making—by dedicated modelling software—a three-dimensional model which is delivered to a 3D printer configured for making the corresponding physical model of the digital mathematical model by depositing a material one layer on another, by advancing by cross-sections towards the top.

The term "3D printer" means a device configured for making a three-dimensional physical model by means of an additive manufacturing 3D-printing process. Particularly, the 3D printer comprises at least one supplying head 101 configured for depositing a predetermined quantity of material. The 3D printer comprises a movement system 102 connected to the supplying head 101 which is configured for moving this latter according to a three-dimensional space.

Moreover, the 3D printer can comprise a control unit 103 connected to the movement system 102 and to the supplying head 101; the control unit 103 is configured for receiving and processing a digital mathematical model and for commanding the activation of the movement system 102 and supplying head 101 for defining the stratification (layer-by-layer) of the processed model. The 3D printer is configured, starting from an object designed/drawn by software, for physically reproducing it by suitable materials.

The term "control unit" 103 means an electronic-type component which can comprise at least one of: a digital processor (CPU), a memory (or memories), an analog-type circuit, or a combination of one or more digital processing units with one or more analog-type circuits. The control unit can be "configured" or "programmed" for executing some steps: this can be physically obtained by any means enabling to configure or program the control unit. For example, when a control unit comprises one or more CPUs and one or more memories, one or more programs can be stored in suitable memory banks connected to the CPU or CPUs; the program or programs contain instructions which, when are executed by the CPU or CPUs, program or configure the control unit for executing operations described with reference to the control unit. As an alternative, if the control unit is or comprises an analog-type circuitry, then the circuit of the control unit can be designed to include a configured circuitry, when used, for processing electric signals in order to execute the steps regarding the control unit.

The term "cementitious material" means a material comprising at least partially a composition of cementitious material, or a cementitious material as specifically described in the following. Particularly, the term "cementitious material" means a material comprising fully, particularly exclusively, said composition of cementitious material or a cementitious composition. Particularly, the term "cementitious material" means a material obtained by a composition of cementitious material or a cementitious composition as specifically described in the following. Particularly, the cementitious material is obtained by 3D-printing a cementitious composition according to the hereinbelow description.

1. STRUCTURE

Figure 1:
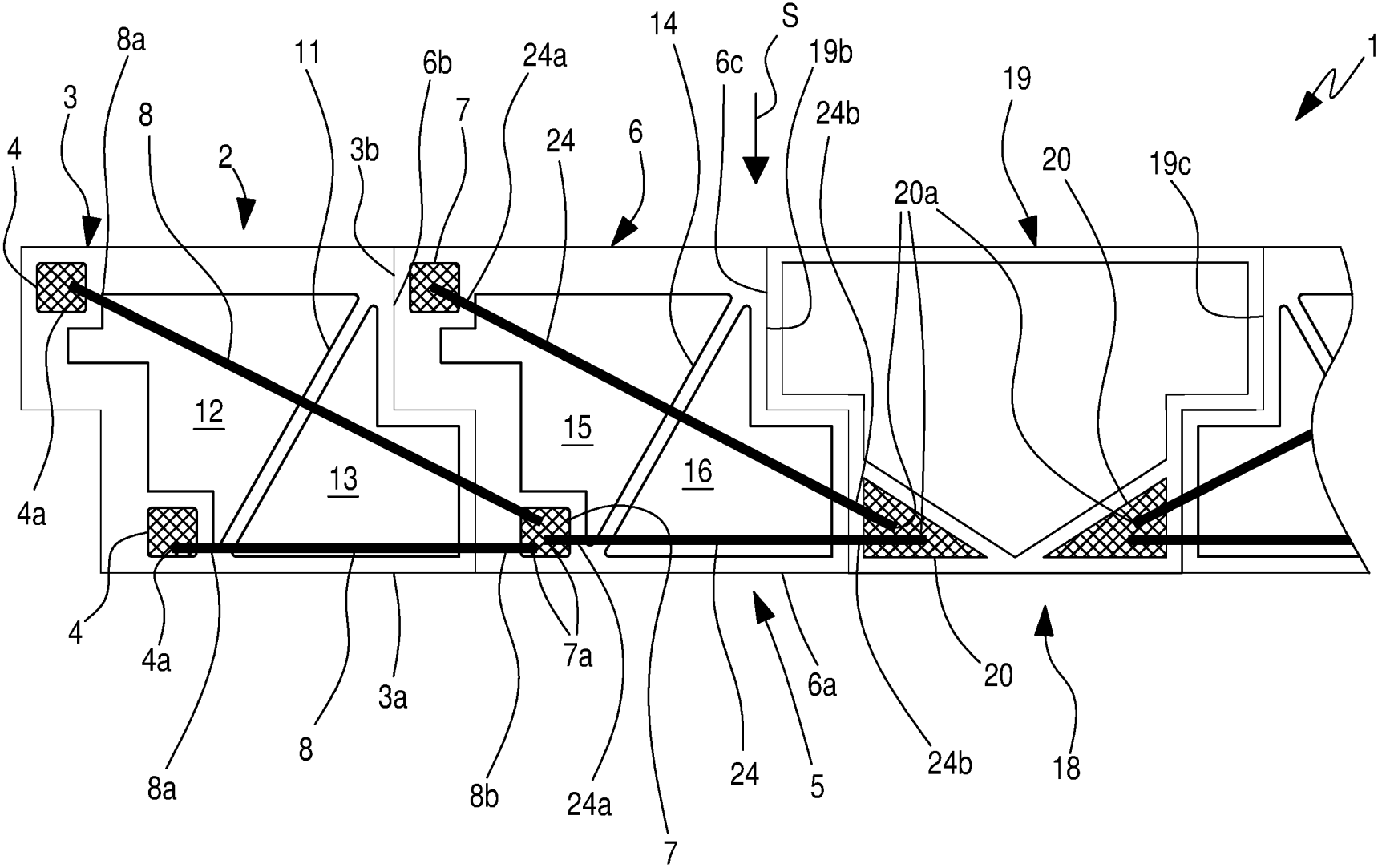
FIG. 1 is a schematic view of a first embodiment of a structure of reinforced cementitious material according to the present invention.
Figure 2:
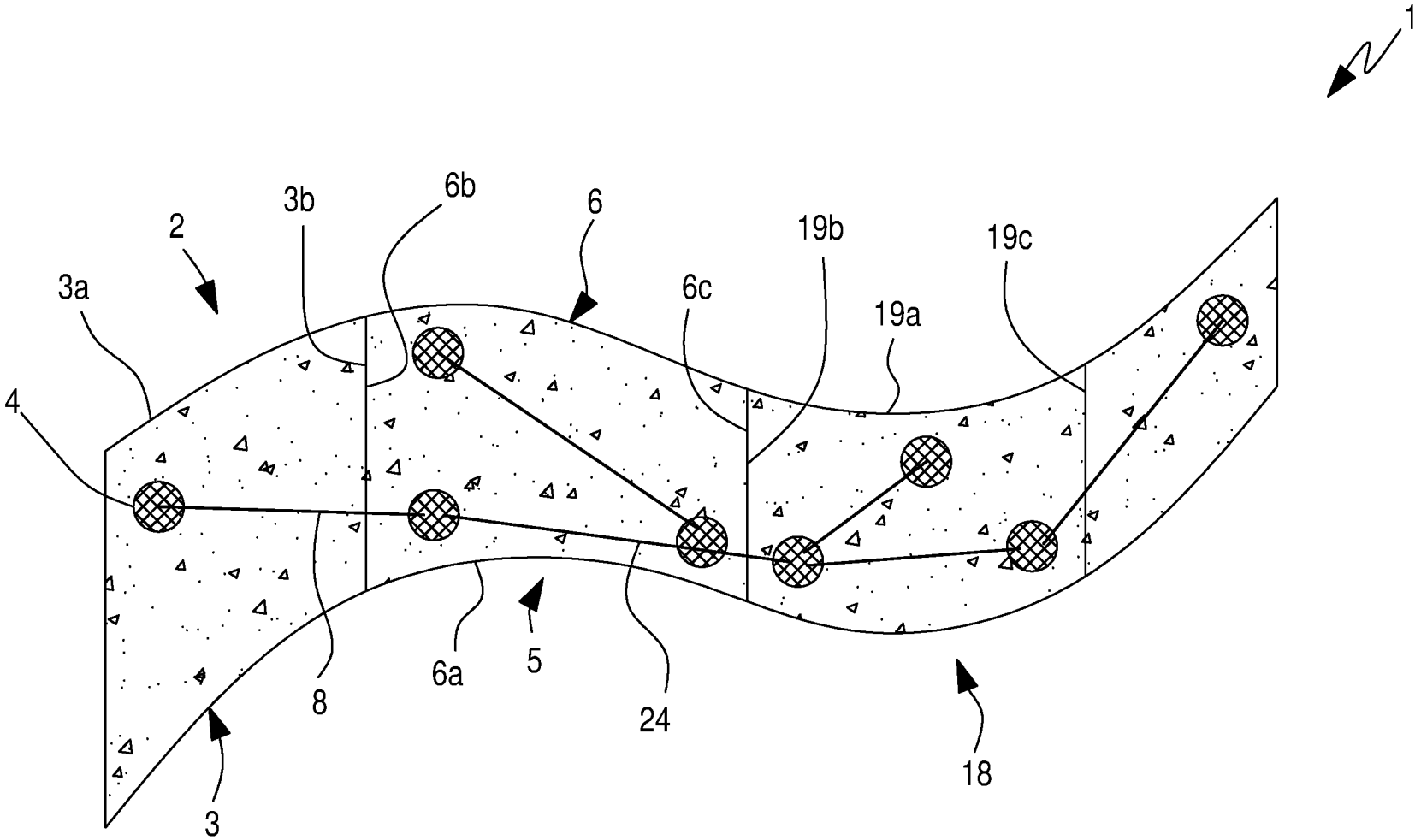
FIG. 2 is a schematic view of a second embodiment of a structure of reinforced cementitious material according to the present invention.
Figures 3, 4:
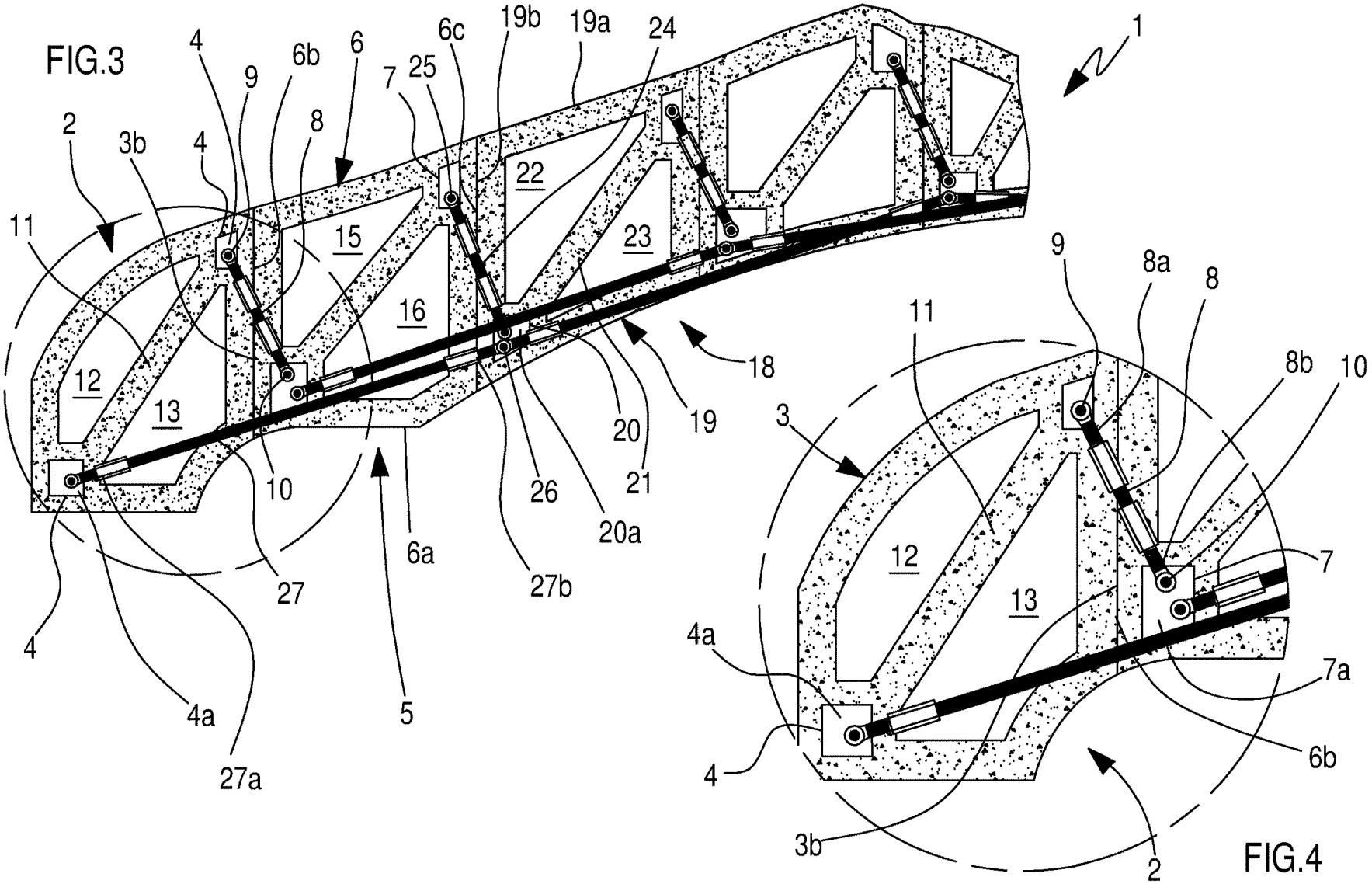
FIG. 3 is a schematic view of a third embodiment of a structure of reinforced cementitious material according to the present invention.
FIG. 4 is a detailed view of the structure of reinforced cementitious material of FIG. 3.

1 generally indicates a structure of reinforced cementitious material, for example, useable in the architectural and building fields, for example for erecting buildings, and also in the construction engineering field. As it is visible for example in FIGS. from 1 to 3, the structure 1 comprises a plurality of modules of cementitious material each of them, as will be better described in the following, is manufacturable by a three-dimensional printing process. More particularly, the structure 1 comprises at least one first module 2 externally delimited by a lateral wall 3 which defines an outer lateral surface 3*a* of the first module 2. As it is for example visible in FIG. 8, the lateral wall 3 of the first module 2 extends along a stratification direction D between a first and second ends; the stratification direction D, as will be better described in the following, is a direction along which the three-dimensional printing process deposits a plurality of layers L of cementitious material one on the other (FIGS. 10 and 11). In a preferred but non-limiting embodiment of the invention, the first module 2 exhibits, along the stratification direction D, a substantially constant cross-section essentially defining a profiled element. More particularly, the first module 2 exhibits, along a cross-section perpendicular to the stratification direction D, a closed outer perimeter having, for example, a polygonal shape (see FIG. 9 for example). In a preferred but non-limiting embodiment of the invention, the first module 2 comprises an internally hollow body; particularly, the first module 2 comprises at least one seat defined inside the closed outer perimeter, which develops for all the extension of said first module 2 along the stratification direction D: the through seat extends between the first and second ends of the module 2. As it is visible in FIGS. from 1 to 4 and 12, for example, at least part of the outer lateral surface 3*a* of the first module 2 defines a reciprocal coupling surface 3*b* which, as will be better described in the following, is configured for abutting on a respective reciprocal coupling surface of a further module. As it is visible in FIGS. 1, 8 and 9, for example, at least part of the lateral surface 3*a* of the first module 2 can define a further reciprocal coupling surface 3*c* opposite to the reciprocal coupling surface 3*b* of the module 2 itself. In a preferred but non-limiting embodiment of the invention, the further reciprocal coupling surface 3*c* of the first module 2 exhibits the same shape and size as the reciprocal coupling surface 3*b* of the module 2 itself; the further reciprocal coupling surface 3*c* of the first module is configured for abutting on a reciprocal coupling surface and/or on a further reciprocal coupling surface of a further module. Moreover, the first module 2 comprises at least one hooking portion 4 defining at least one cavity 4*a* extending at least partially along the stratification direction D of the module 2 itself. In the configuration wherein the first module 2 comprises a closed outer outline lateral wall 3, the hooking portion 4 is defined inside said closed outer perimeter; optionally the portion 4 extends for all the development of the first module 2 along the stratification direction D, in other words from the first to the second ends of the first module 2. FIGS. 1, 3 and 4 illustrate in a non-limiting way a first module 2 exhibiting two hooking portions 4. FIG. 2 illustrates an embodiment variant wherein the first module 2 exhibits only one hooking portion 4. However, it is not excluded the possibility of making a first module 2 exhibiting a number of hooking portions 4 greater than 2. Particularly, the first module 2 can exhibit a number of hooking portions 4 equal to or comprised between 1 and 10, particularly between 1 and 5, still more particularly between 1 and 4. Each hooking portion 4 can define only one cavity 4*a* or a plurality of cavities in a number for example comprised between 1 and 4. As it is visible in FIGS. 1, 3, 4, 8 and 9 for example, the first module 3 can comprise inside the closed outer perimeter—a reinforcing portion 11 extending inside the closed outer perimeter between two sides substantially opposite to each other. Advantageously but in a non-limiting way, the reinforcing portion 11 of the first module 2 extends along the stratification direction D along all the development of the first module 2, particularly from the first to the second ends of the first module 2. The reinforcing portion 11 defines, cooperatively with the lateral wall 3 of the first module 2, at least one first and one second flanked through seats 12, 13 and both defined inside the closed outer perimeter of the first module 2 (see FIGS. 1 and 9 for example).

From the dimensional point of view, the first module 2 can exhibit a height—defined along the stratification direction D—greater than 100 mm, particularly greater than 200 mm, still more particularly comprised between 250 and 1,000 mm. Moreover, the first module can exhibit a length and a width—measured perpendicular to the stratification D and perpendicular to each other—greater than 100 mm, particularly greater than 200 mm, still more particularly comprised between 250 and 3,000 mm.

As it is visible in the attached figures, moreover the structure 1 comprises at least one module 5 externally delimited by a lateral wall 6 which defines an outer lateral surface 6*a* of the second module 5. The lateral wall 6 of the second module 5 extends along a stratification direction between a first and second ends; the stratification direction, as will be better described in the following, is a direction along which the three-dimensional printing process deposits a plurality of layers L of cementitious material one on the other (FIGS. 10 and 11). The stratification direction D of the first module 2 and the stratification direction of the second module 5 are parallel to each other. In a preferred but non-limiting embodiment of the invention, the second module 5 exhibits, along the stratification direction, a substantially constant cross-section essentially defining a profiled element. More particularly, the second module 5 exhibits, along a cross-section perpendicular to the stratification direction, a closed outer perimeter having a polygonal shape for example. In a preferred but non-limiting embodiment of the invention, the second module 5 comprises an internally hollow body; particularly, the second module 5 comprises at least one seat defined inside the closed outer perimeter which extends for all the extension of said second module along the stratification direction: the through seat extends between the first and second ends of the module 5. At least part of the outer lateral surface 6*a* of the second module 5 defines a reciprocal coupling surface 6*b* countershaped and in contact with the reciprocal coupling surface 3*b* of the first module 2. As it is visible in FIGS. from 1 to 3 for example, at least part of the lateral surface 6*a* of the second module 5 can define a further reciprocal coupling surface 6*c* opposite to the reciprocal coupling surface 6*b* of the module 5 itself. In a preferred but non-limiting embodiment of the invention, the further reciprocal coupling surface 6*c* of the second module 5 exhibits the same shape and size as the reciprocal coupling surface 6*b* of the module 5 itself; the further reciprocal coupling surface 6*c* of the second module 5 abuts on a reciprocal coupling surface and/or on a further reciprocal coupling surface of a further module. The second module 5 comprises at least one hooking portion 7 defining at least one cavity 7*a* extending at least partially along the stratification direction of the module 5. In the configuration wherein the second module 5 comprises the lateral wall 6 having a closed outer outline, the hooking portion 7 is defined inside said closed outer perimeter; optionally, the portion 7 extends for all the development of the second module 5 along the stratification direction, in other words from the first to the second ends of the second module 5. FIGS. 1 and 3 illustrate, in a non-limiting way, a second module 5 exhibiting two hooking portions 7. FIG. 2 illustrates an embodiment variant wherein the second module exhibits three hooking portions 7. However, it is not excluded the possibility of making the second module 5 so that is has only one hooking portion 7 or a number of hooking portions 7 greater than three. Particularly, the second module 5 can exhibit a number of hooking portions 7 equal to or comprised between 1 and 10, particularly between 1 and 5, still more particularly between 1 and 4. Each hooking portion 7 can define only one cavity 7*a* or a plurality of cavities, for example in a number comprised between 1 and 4. As it is visible in FIGS. 1, 3, 13 and 14 for example, the second module 2 can comprise—inside the closed outer perimeter—a reinforcing portion 14 which extends inside the closed outer perimeter between two sides substantially opposite to each other. Advantageously, but in a non-limiting way, the reinforcing portion 14 of the second module 5 extends along the stratification direction for all the development of the second module 5, particularly from the first to the second ends of the module 5. The reinforcing portion 14 defines, cooperatively with the lateral wall 6 of the second module 5, at least one first and one second flanked through seats 15, 16 and both defined inside the closed outer perimeter of the second module 5 (see FIGS. 1 and 3, for example).

From the dimensional point of view, the second module 5 can exhibit a height—defined along the stratification direction of the module 5 itself—greater than 100 mm, particularly greater than 200 mm, still more particularly comprised between 250 and 1,000 mm. In an embodiment illustrated in the attached figures, the first and second modules 2, 5 exhibit substantially the same height: the first and second ends of the first module are respectively disposed at the first and second ends of the second module 5. Moreover, the second module 5 can exhibit a length and width—measured perpendicularly to the stratification direction of the module 5 itself and perpendicular to each other—greater than 100 mm, particularly greater than 200 mm, still more particularly comprised between 250 and 3,000 mm. FIG. 1 illustrates—in a non-limiting way—an embodiment of the structure 1 wherein the first and second modules 2, 5 are identical to each other by shape and size. As it is visible in the attached figures, the structure 1 can comprise, in a non-limiting way, at least one third module 18 externally delimited by a lateral wall 19 which defines an outer lateral surface 19*a* of the third module 18. The lateral wall 19 of the third module 18 extends along a stratification direction between a first and second ends; the stratification direction, as will be better described in the following, is a direction along which the three-dimensional printing process deposits a plurality of layers L of cementitious material one on the other. The stratification direction of the first and second modules 2, 5 is parallel to the stratification direction of the third module 18. In a preferred but non-limiting embodiment of the invention, the third module 18 exhibits, along the stratification direction, a substantially constant cross-section essentially defining a profiled element. More particularly, the third module 18 exhibits, along a cross-section perpendicular to the stratification direction, a closed outer perimeter having a polygonal shape for example. In a preferred but non-limiting embodiment of the invention, the third module 18 comprises an internally hollow body; particularly, the second third 18 comprises at least one seat defined inside the closed outer perimeter which extends for all the extension of said second module along the stratification direction: the through seat extends between the first and second ends of the module 18. At least part of the outer lateral surface 19*a* of the third module 18 defines a reciprocal coupling surface 19*b* countershaped to and in contact with the further reciprocal coupling surface 6*c* of the second module 5. As it is visible in FIGS. from 1 to 3, for example, at least part of the lateral surface 19*a* of the third module 18 can define a further reciprocal coupling surface 19*c* opposite to the reciprocal coupling surface 19*b* of the module 18 itself. In a preferred but non-limiting embodiment of the invention, the further reciprocal coupling surface 19*c* of the third module 18 exhibits the same shape and size as the reciprocal coupling surface 19*b* of the module 18 itself; the further reciprocal coupling surface 19*c* of the third module 18 abuts on a reciprocal coupling surface and/or a further reciprocal coupling surface of a further module. The third module 18 comprises at least one hooking portion 20 defining at least one cavity 20*a* extending at least partially along the stratification direction of the module 18. In the configuration wherein the third module 18 comprises a closed outer outline lateral wall 19, the hooking portion 20 is defined inside said closed outer perimeter; optionally the portion 20 extends for all the development of the third module 18 along the stratification direction, in other words from the first to the second ends of the third module 18. FIGS. 1 and 3 illustrate in a non-limiting way a third module 18 exhibiting two hooking portions 20. FIG. 2 illustrates an embodiment variant wherein the third module exhibits three hooking portions 20. However, it is not excluded the possibility of making a third module 18 exhibiting only one hooking portion 20 or a number of hooking portions 20 greater than three. Particularly, the third module 18 can exhibit a number of hooking portions 20 equal to or comprised between 1 and 10, particularly between 1 and 5, still more particularly between 1 and 4. Each hooking portion 20 can define only one cavity 20*a* or a plurality of cavities, for example in a number comprised between 1 and 4. As it is visible in FIG. 3 for example, the third module 18 can comprise—inside the closed outer perimeter—a reinforcing portion 21 extending inside the closed outer perimeter between two sides substantially opposite to each other. Advantageously, but in a non-limiting way, the reinforcing portion 21 of the third module 18 extends along the stratification direction for all the development of the third module 18, particularly from the first to the second ends of the module 18. The reinforcing portion 21 defines, cooperatively with the lateral wall 19 of the third module 18, at least one first and one second flanked through seats 22, 23 both defined inside the closed outer perimeter of the third module 18 (see FIG. 3, for example). From the dimensional point of view, the third module 18 can exhibit a height—defined along the stratification direction of the module 18 itself—greater than 100 mm, particularly greater than 200 mm, still more particularly comprised between 250 and 3,000 mm. In an embodiment illustrated in the attached figures, the second and third modules 5, 18 exhibit substantially the same height (so that the third module exhibits substantially the same height as the first module): the first and second ends of the second module are respectively disposed at the first and second ends of the first module 18. Moreover, the third module 18 can exhibit a length and width—measured perpendicularly to the stratification direction of the module 18 itself and perpendicularly to each other—greater than 100 mm, particularly greater than 200 mm, still more particularly comprised between 250 and 3,000 mm.

FIG. 1 illustrates an embodiment of the structure wherein the first and second modules 2, 5 are identical to each other by shape and size, while the third module exhibits a shape and size different from said modules 2 and 5. However, it is not excluded the possibility of making a structure 1 wherein the third module 18 is identical by shape and size to the first and second modules. As it is visible in the attached figures, the structure 1 can comprise a plurality of modules in contact with each other and aligned along a direction A (see FIG. 14 for example) perpendicular to a stratification direction of each module. For example, the structure 1 can comprise a number of modules greater than 3; particularly the structure 1 can comprise a number of modules greater than 4, particularly greater than 5, still more particularly comprised between 5 and 20. At least part of the plurality of modules of the structure 1 can comprise a reciprocal coupling surface and a further reciprocal coupling surface opposite to each other with respect to the module itself; the reciprocal coupling surface of a module abuts on a reciprocal coupling surface and/or on a further reciprocal coupling surface of an immediately adjacent module (modules in contact with each other). The modules can be all different from each other by shape and size or can be at least partially identical to each other by shape and size. The shape and/or size of the above described modules can be determined by a process optimizing the topology, which maximizes the mechanical performance of the block. As it is visible in Figures from 1 to 3 and 6, for example, moreover the structure comprises at least one connecting element 8 engaged, on one side, inside the cavity 4*a* of the hooking portion 4 of the first module 2 and, on the other side, inside the cavity 7*a* of the hooking portion 7 of the second module 5: the connecting element 8 stably constrains the first and second modules 2, 5 and is configured for holding these latter in contact with each other. De facto, the connecting element acts as an outer reinforcing element providing the structure with strength to tensile loads.

Figure 5:
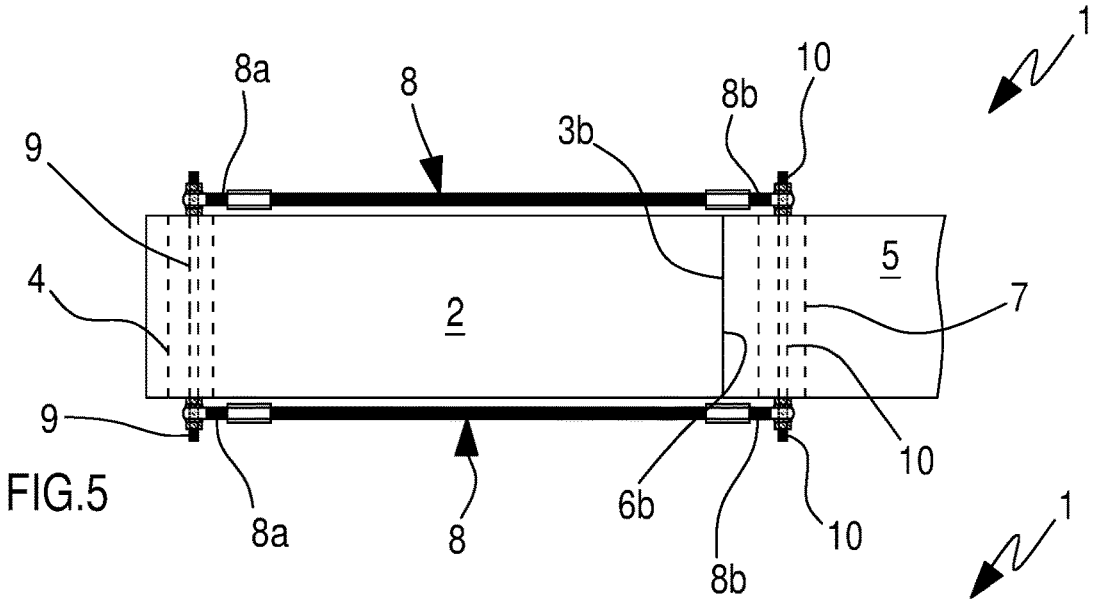
FIGS. 5 and 6 are respectively a top view and a front view of a structure of cementitious material according to the present invention.
Figure 6:
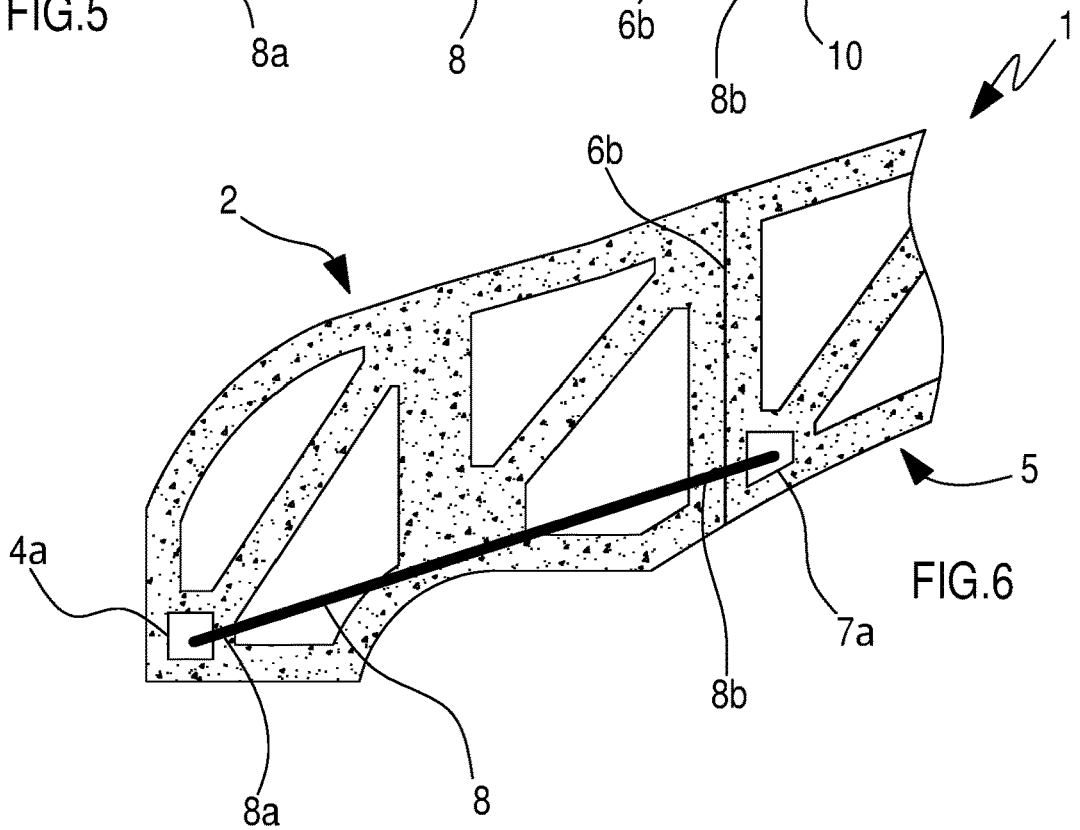
Figure 7:
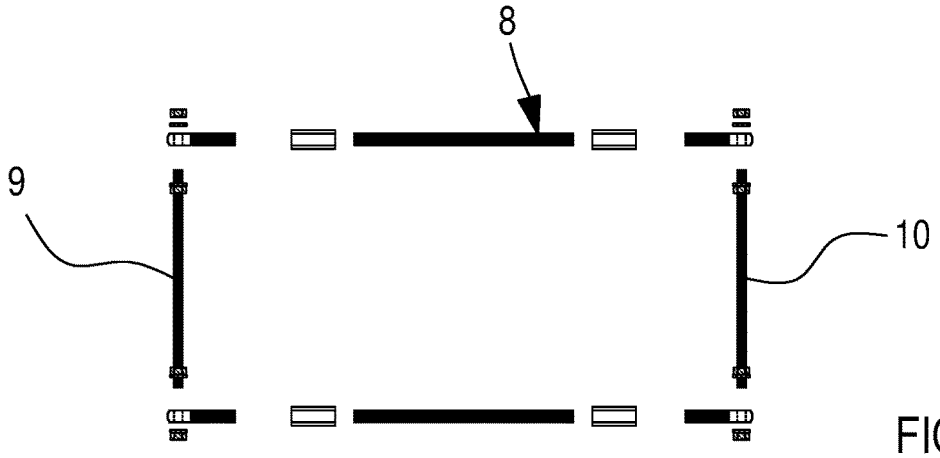
FIG. 7 is an exploded view of a connecting element of the reinforced cementitious material according to the present invention.

More particularly and as it is visible in the attached figures, the connecting element 8 comprises at least one reinforcing bar, optionally of metal material, extending along a longitudinal development direction between a first and second end portions 8*a*, 8*b*: the longitudinal development direction of the bar is transversal, particularly perpendicular, to the stratification direction of the first and second modules. The connecting element 8 comprises—at the first end portion 8*a*—a first engagement portion 9 emerging from the reinforcing bar transversally to the longitudinal development direction of the same and engaged inside the cavity 4*a* of the hooking portion 4 of the first module 2. Moreover, the connecting element 8 comprises—at the second end portion 8*b*—a second engagement portion 10 emerging from the reinforcing bar transversally to the longitudinal development direction of the same and engaged inside the cavity 7*a* of the hooking portion 7 of the second module 2. De facto, the portions 9 and 10 partially cross—along the height—the first and second modules 2, 5 while the reinforcing bar is disposed outside the lateral wall and the through seat of the respective modules. The reinforcing bar is essentially an outer connecting bar between the portions 9, 10 which are engaged inside the respective modules; the bar essentially acts as a tie in relation to the tensile stresses generated in the system. Moreover, the connecting element 8 can comprise only one reinforcing bar adapted to connect the engagement portions 9 and 10. FIGS. 5 and 6 illustrate a preferred embodiment of the connecting element 8 which exhibits a first and second engagement portions 9, 10 vertically crossing the first and second modules and exhibiting respective end portions emerging from the first and second ends of the respective modules (FIG. 5). With such arrangement, the connecting element 8 exhibits two reinforcing bars disposed at the first and second ends of the module 2 and 5: the bars are disposed opposite to each other with respect to the modules 2 and 5. A first reinforcing bar is constrained to the first end portion of the portions 9 and 10 while a second bar is constrained to the second end portion of the portions 9 and 10. Both the reinforcing bars are disposed outside the modules 2, 5 and respectively at the first and second ends of these latter. FIG. 2 illustrates an embodiment of the structure 1, comprising only one connecting element 8 adapted to constrain the first and second modules 2. FIG. 1 illustrates a preferred but non-limiting embodiment of the invention wherein the structure comprises two connecting elements adapted to stably constrain the first and second modules 2, 5. However it is not excluded the possibility of defining a structure 1 comprising a number of connecting elements 8 equal to or greater than 3, particularly comprised between 3 and 10, still more particularly between 3 and 5. In a preferred but non-limiting embodiment of the invention illustrated in FIGS. 3, 4, 5 and 7 for example, the first and second engagement portions 9, 10 of the connecting element 8 are distinct and removably associable to the reinforcing bar. Particularly, the first and second engagement portions 9, 10 can for example comprise respective threaded bars: the reinforcing bar can comprise, for example, a bar exhibiting at the end portions 8*a*, 8*b* an engagement portion shaped as an eyelet or slot inside which part of the threaded bar of the portions 9 and 10 can be housed. The reinforcing bar can be fixed to the respective engagement portions by bolts engaging the threaded bars of the portions 9 and 10 and which therefore constrain the engagement portions of the reinforcing bar to the portions 9 and 10. FIG. 18 illustrates an embodiment variant of the connecting element wherein the reinforcing bar and engagement portions 9, 10 are integrally joined for defining a single body having a substantially "C" shape. As it is visible in Figures from 1 to 3 for example, further the structure 1 can comprise at least one connecting element 24 engaging, on one side, inside the cavity 7*a* of the hooking portion 7 of the second module and, on the other side, inside the cavity 20*a* of the hooking portion 20 of the third module 18: the connecting element 24 stably constrains the second and third modules 5, 18, and is configured for holding these latter in contact with each other. More specifically and it is visible in the attached figures, the connecting element 24 comprises at least one reinforcing bar, optionally of metal material, extending along a longitudinal development direction between a first and second end portions 24*a*, 24*b*: the longitudinal development direction of the bar is transversal, particularly perpendicular, to the stratification direction of the first and second modules. The connecting element 24 comprises at the first end portion 24*a*—a first engagement portion 25 emerging from the reinforcing bar transversally to the longitudinal development direction of the same and engaged inside the cavity 7*a* of the hooking portion 7 of the second module 5 (FIG. 3). The connecting element 24 further comprises—at the second end portion 24*b*—a second engagement portion 26 emerging from the reinforcing bar transversally to the longitudinal development direction of the same and engaged inside the cavity 20*a* of the hooking portion 20 of the third module 18. De facto, the portions 25 and 26 vertically cross at least partially the second and third modules 5, 18 while the reinforcing bar is disposed outside the lateral wall and the through seat of the respective modules. The reinforcing bar of the element 24 is essentially an outer connecting bar between the portions 25, 26 which are engaged inside the respective modules. Moreover, the connecting element 24 can comprise only one reinforcing bar adapted to connect the engagement portions 25 and 26. In a preferred embodiment, the connecting element 24 exhibits a first and second engagement portions 25, 26 vertically crossing the second and third modules and exhibiting respective end portions emerging from the first and second ends of the respective modules. With such arrangement, the connecting element 24 exhibits two reinforcing bars disposed at the first and second ends of the modules 5 and 18: the bars are disposed opposite to each other with respect to the modules 5 and 18. A first reinforcing bar is constrained to the first end portions of the portions 25 and 26, while a second bar is constrained to the second end portion of the portions 25 and 26. Both the reinforcing bars are disposed outside the modules 5 and 18 and respectively at the first and second ends of these latter.

Figure 14:
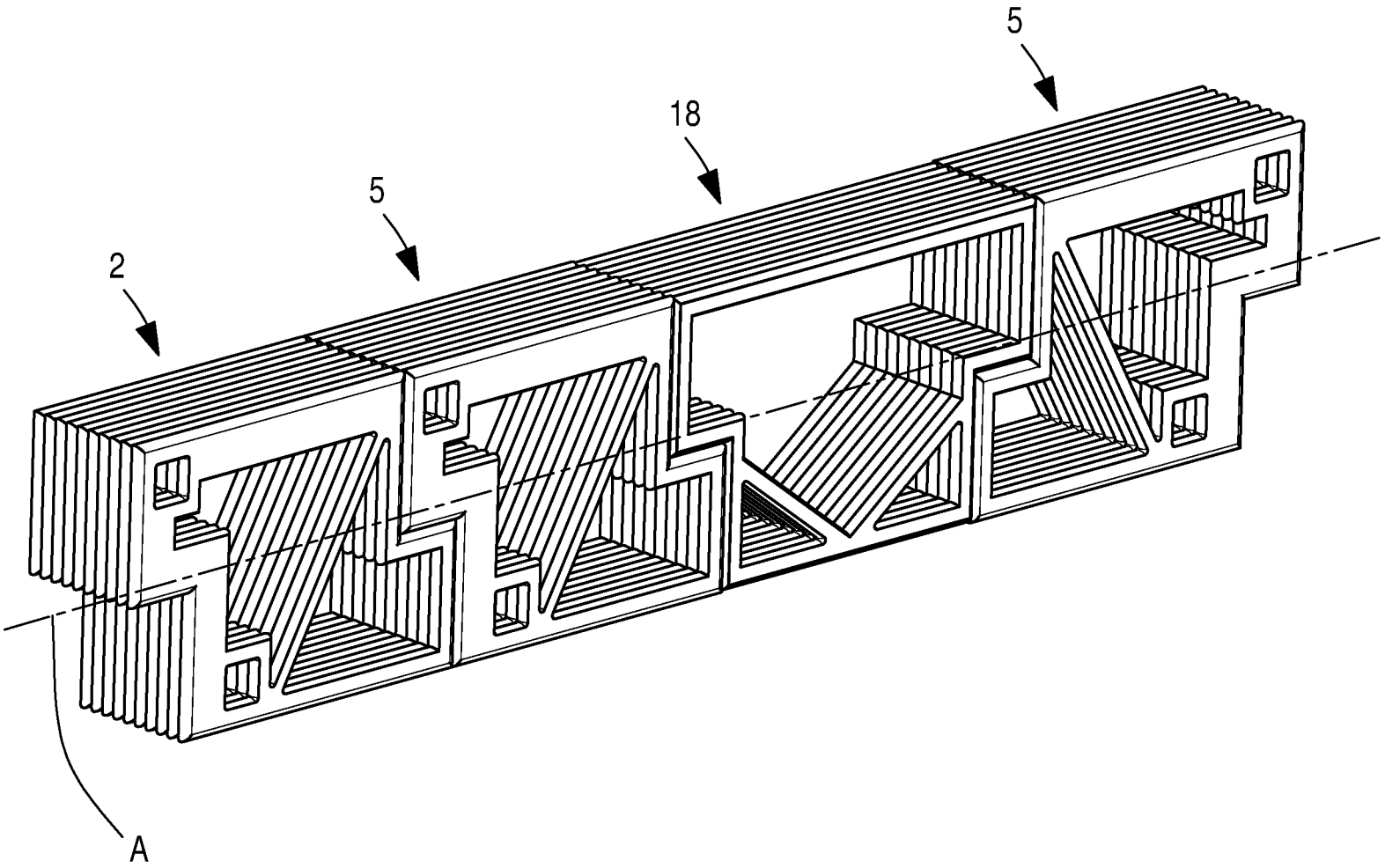
Figure 15:
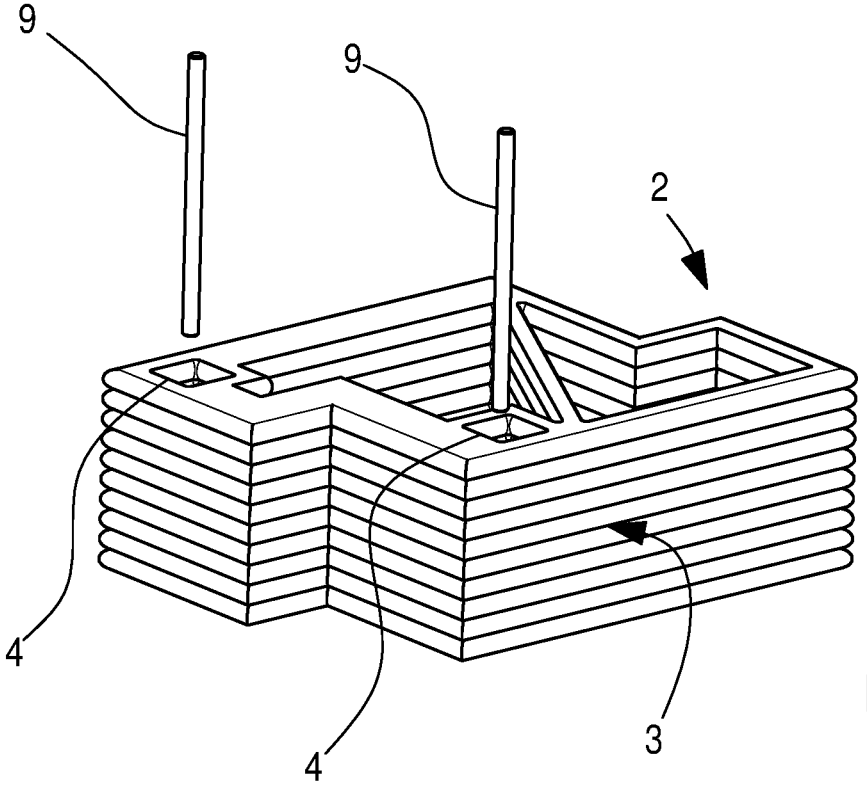
Figure 16:
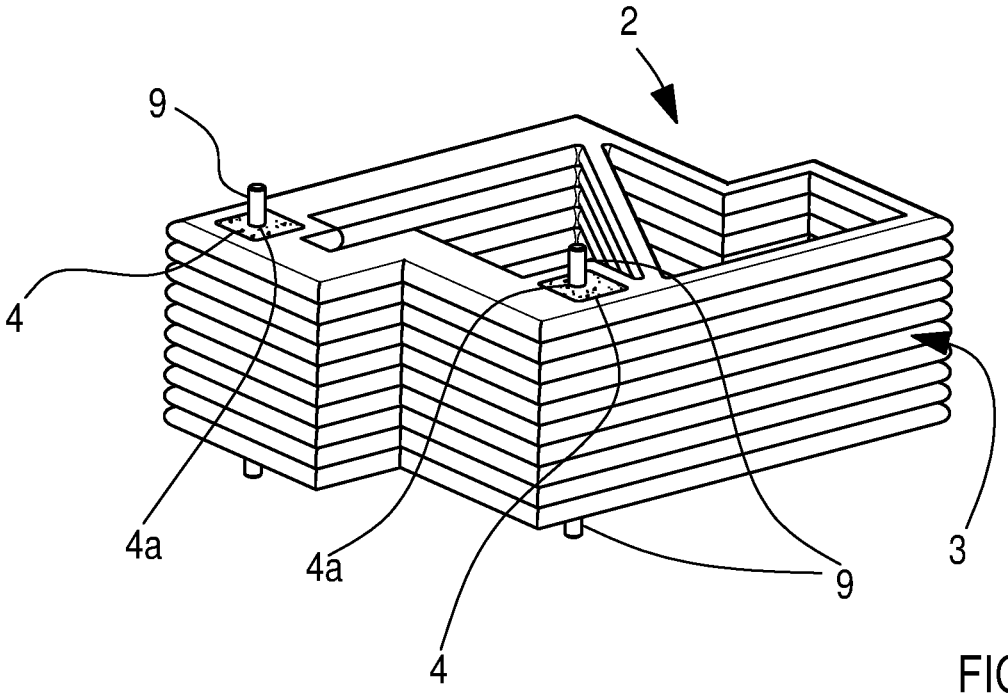

The structure 1 can comprise only one connecting element 24 adapted to constrain the second and third modules 5, 18 (FIG. 2). FIG. 1 illustrates a preferred but non-limiting embodiment of the invention wherein the structure comprises two connecting elements 24 adapted to stably constrain the second and third modules 5, 18. However, it is not excluded the possibility of defining a structure 1 comprising a number of connecting elements 24 equal to or greater than 3, particularly comprised between 3 and 10, still more particularly between 3 and 5. In a preferred but non-limiting embodiment of the invention, the first and second engagement portions 25, 26 of the connecting element 24 are distinct and removably associable to the reinforcing bar. Particularly, the first and second engagement portions 25, 26 can for example comprise respective threaded bars: the reinforcing bar can for example comprise a bar exhibiting, at the end portions 24*a*, 24*b*, an engagement portion shaped as an eyelet or slot inside which part of the threaded part of the portions 25 and 26 can be housed. The reinforcing bar can be fixed to the respective engagement portions by bolts which engage the threaded bars of the portions 25 and 26 which constrain therefore the engagement portions of the reinforcing bar to the portions 25 and 26. In a preferred but non-limiting embodiment of the invention, moreover the structure 1 comprises at least one connecting element 27 engaged, on one side, inside the cavity 4*a* of the hooking portion 4 of the first module 2 and, on the other side, inside the cavity 20*a* of the hooking portion 20 of the third module 18; the connecting element 27 stably constrains the first module and third module 2, 18. As it is visible in FIG. 3, advantageously the connecting element exhibits an arrangement (structure) similar to the connecting elements 8 and 24. As schematically shown in FIG. 1, the structure 1 is configured for mainly opposing, under operative conditions of the same, a stress S directed perpendicularly to the stratification direction of the plurality of modules and perpendicularly to the alignment direction A of the same (the direction A is schematically shown in FIG. 14).

2. PROCESS

Figure 12:
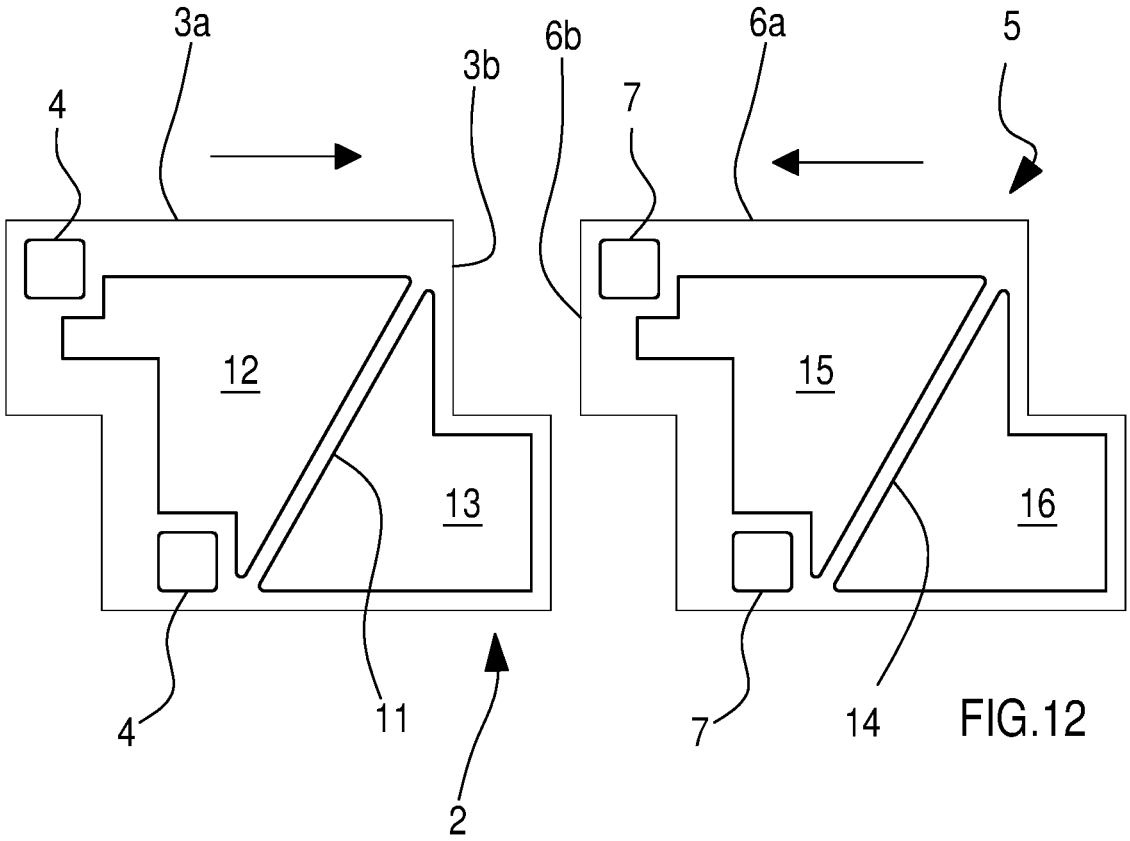
Figure 13:
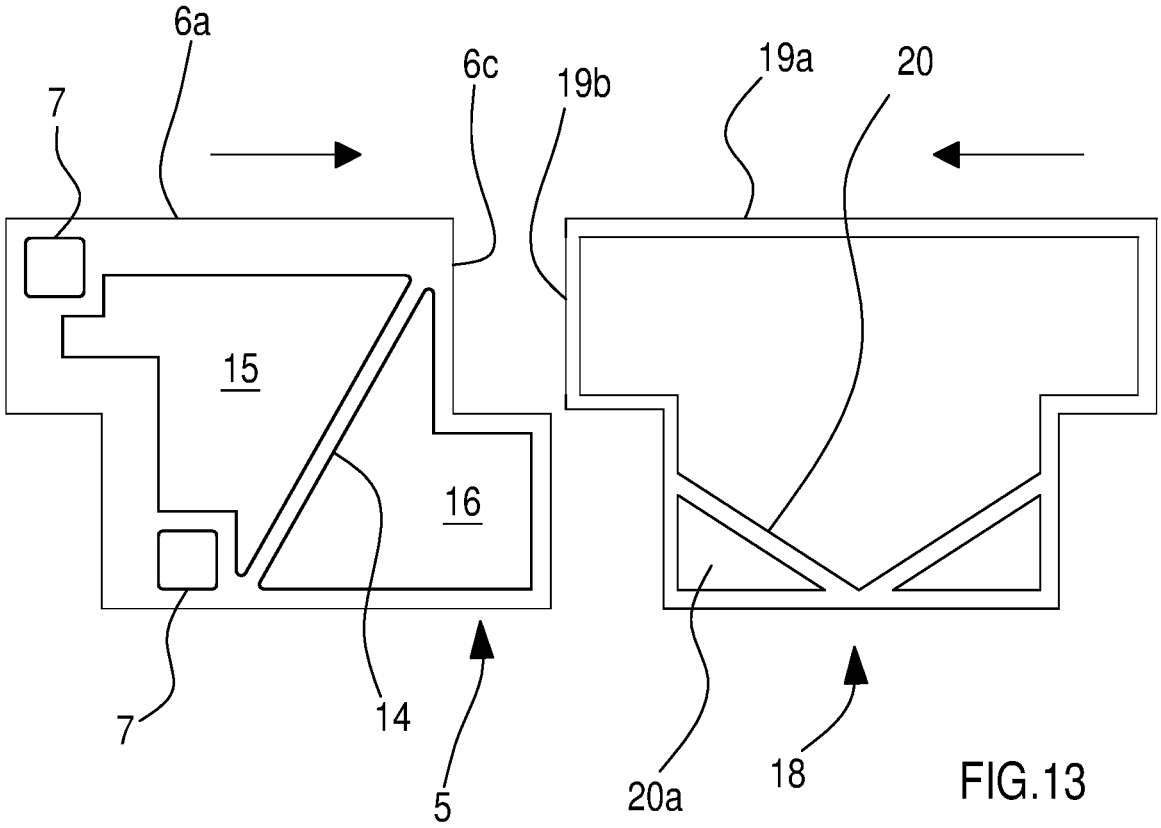

Moreover, it is an object of the present invention a process of making a structure 1 of reinforced cementitious material according to any one of the attached claims and/or according to the above given description. The process comprises a step of making a plurality of modules of cementitious material by a three-dimensional printing process which comprises a step of depositing a plurality of layers L of cementitious material one on the other along a stratification direction D; the layers L exhibit substantially the same shape and size: each module can exhibit, along the stratification direction D, a substantially constant cross-section for essentially defining a profile. However, it is not excluded the possibility of making modules exhibiting—along the stratification direction D—a varying cross-section, obtainable, for example, by a "cantilevered" layer-by-layer printing process. Particularly, by the three-dimensional printing process, the first and second modules 2, 5 and optionally also the third module 18 are obtained. FIGS. 10 and 11 schematically illustrate the three-dimensional printing process of making the first module 2. The head 101 of the 3D printer deposits one layer L on another layer of cementitious material for defining a cross-section of the module. By the same process, the second module 5 (the configuration thereof is not illustrated in the attached figures) and optionally the third module 18 are made. After, the first and second modules 2, 5 are disposed in contact with each other so that the respective reciprocal coupling surfaces 3*b*, 6*b* of said modules abut on each other (FIG. 12 illustrates a step of approaching the modules 2 and 5). Optionally, if the third module 18 is present, the process comprises a step of contacting the second and third modules so that the further reciprocal coupling surface 6*c* of the second module 5 abuts on the reciprocal coupling surface 19*b* of the third module 18 (FIG. 13 illustrates a step of approaching the modules 5 and 18). After the step of contacting the first and second modules, the process comprises a step of engaging at least one connecting element 8, from one side, inside the cavity 4*a* of the hooking portion 4 of the first module 2 and, on the other side, inside the cavity 7*a* of the hooking portion 7 of the second module 5; the connecting element 8 stably constrains the first and second modules 2, 5 and is configured for holding these latter in contact with each other. More specifically, the step of engaging the connecting element 8 to the first and second modules 2, 5 comprises at least the following sub-steps:

- stably engaging the first engagement portion 9 inside the cavity 4*a* of the hooking portion 4 of the first module 2,
- stably engaging the second engagement portion 10 inside the cavity 7*a* of the hooking portion 7 of the second module 5.

FIG. 18 illustrates a step of inserting the connecting element 8 comprising the engagement portions 9, 10 integrally joined to the reinforcing bar.

As hereinbefore described, the connecting element 8 can comprise engagement portions 9, 10 distinct and removable from the reinforcing bar; in such arrangement, the step of engaging the connecting element 8 comprises the following sub-steps:

- inserting the first engagement portion 9 inside the cavity 4*a* of the hooking portion 4 of the first module 2,
- filling at least partially the cavity 4*a* of the hooking portion 4 of the first module 2 with a cementitious material at least partially at a liquid state so that this latter can contact at least part of said first engagement portion 9,
- constraining, by hardening the cementitious material inside the cavity 4*a* of the first module 2, said first engagement portion 9,
- inserting the second engagement portion 10, for example before a step of hardening the cementitious material present in the cavity 4*a*, inside the cavity 7*a* of the hooking portion 7 of the second module 5,
- filling at least partially the cavity 7*a* of the hooking portion 7 of the second module 5 with a cementitious material at least partially at a liquid state so that this latter can contact at least part of said second engagement portion 10,
- constraining, by hardening the cementitious material inside the cavity 7*a* of the second module 5, said second engagement portion 10.

After engaging the engagement portions 9, 10 with the modules 2 and 5, the process comprises a step of constraining (fixing) the reinforcing bar to said first and second engagement portions 9, 10. The process, simultaneously with or after the step of engaging the connecting element 8 with the first and second modules, can comprise at least one step of further fixing the first and second modules which comprises at least the following sub-steps:

- providing between the reciprocal coupling surfaces of the first and second modules, a predetermined quantity of cementitious material at least partially at a liquid state,
- further constraining, by hardening said cementitious material disposed between the reciprocal coupling surfaces, said first and second modules.

If a third module 18 is present, moreover the process can comprise a step of engaging at least one connecting element 24, on one side, inside the cavity 7*a* of the hooking portion 7 of the second module 5 and, on the other side, inside the cavity 20*a* of the hooking portion 20 of the third module 18; the connecting element 24 stably constrains the second module 5 and third module 18 and is configured for holding these latter in contact with each other. More specifically, the step of engaging the connecting element 24 with the second and third modules comprises at least the following sub-steps:

- stably engaging the first engagement portion 25 inside the cavity 7*a* of the hooking portion 7 of the second module 5,
- stably engaging the second engagement portion 26 inside the cavity 20*a* of the hooking portion 20 of the third module 18.

As hereinbefore described, the connecting element 24 can comprise engagement portions 25 distinct and removable from the reinforcing bar; in such arrangement, the step of engaging the connecting element 24 comprises the following sub-steps:

- inserting the first engagement portion 25 inside the cavity 7*a* of the hooking portion 7 of the second module 5,
- filling at least partially the cavity 7*a* of the hooking portion 7 of the second module 5 with a cementitious material at least partially at a liquid state so that this latter can contact at least part of said first engagement portion 25,
- constraining, by hardening the cementitious material inside the cavity 7*a* of the second module 5, said first engagement portion 25,
- inserting the second engagement portion 26 inside the cavity 20*a* of the hooking portion 20 of the third module 18,
- filling at least partially the cavity 20*a* of the hooking portion 20 of the third module 18 with a cementitious material at least partially at a liquid state so that this latter can contact at least part of said second engagement portion 26,
- constraining, by hardening the cementitious material inside the cavity 20*a* of the third module 18, said second engagement portion 26.

After constraining the engagement portions 25, 26 with the modules 5 and 18, the process comprises a step of constraining (fixing) the reinforcing bar to said first and second engagement portions 25 and 26. The process, simultaneously with or after the step of engaging the connecting element 24 with the second and third modules, can comprise at least one step of further fixing the first and second modules which comprises at least the following sub-steps:

providing between the reciprocal coupling surfaces of second and third modules, a predetermined quantity of cementitious material at least partially at a liquid state, further constraining, by hardening said cementitious material placed between the reciprocal coupling surfaces, said second and third modules.

Moreover, the process can comprise a step of engaging at least one connecting element 27 (the structure thereof can be identical to the connecting elements 8 and/or 24, for example), on one side, inside the cavity 4*a* of the hooking portion 4 of the first module 2 and, on the other side, inside the cavity 20*a* of the hooking portion 20 of the third module 18: the connecting element 27 stably constrains the first module and third modules 2, 18.

3. CEMENTITIOUS COMPOSITION

The present inventors have found that a cementitious composition comprising cement, an inert aggregate, a polymeric fiber, a superfluidifying agent and water, characterized by specific quantities of the components, by the ratio between the water quantity and cement quantity, by the quantity of the superfluidifying agent and by the granulometry of the inert aggregate, is particularly adapted to make structures of reinforced cementitious material by the 3D printing process of the present invention. Particularly, the present inventors, starting from the water/cement ratio necessary to obtain the required mechanical performance and the required setting and hardening kinetics, have optimized the consistency of the mixture by using a fluidifying agent having a specific quantity in relation with the granulometry and capable of absorbing the inert aggregate. Therefore, it is a further aspect of the present invention a cementitious material for making the structure 1 of a reinforced cementitious material according to any one of the attached claims and/or according to the above given description. Therefore, a further aspect of the invention provides a cementitious composition M comprising:

(i) from 15 to 30% by weight of cement with respect to the total weight of the composition, (ii) from 60 to 80% by weight of at least one inert aggregate, alone or in a mixture with one or more other inert aggregates, with respect to the total weight of the composition, (iii) from 0.02 to 0.75% by weight of at least one polymeric fiber, alone or in a mixture with one or more other polymeric fibers, with respect to the total weight of the composition, (iv) from 0.03 to 0.1% by weight of at least one superfluidifying agent, alone or in mixture with one or more other superfluidifying agents, with respect to the total weight of the composition, and (v) water in a quantity sufficient to reach 100% by weight of the composition, optionally, it can be present:

(vi) from 0.1 to 2.5% by weight of at least one viscosity modifying agent with respect to the total weight of the composition, wherein:

the weight ratio between water and cement is comprised between 0.3 and 0.45 or the ratio between water and the equivalent cement is comprised between 0.29 and 0.49; and the maximum diameter of the at least one inert aggregate is less than 12.5 mm.

According to a further aspect of the invention (cementitious composition) a suitable cement is selected among those belonging to the types I, II, III, IV and V, established by the standard EN 197-1, accepted at a national level by the standard UNI EN 197/1. According to a further aspect of the invention, a suitable cement is selected among those belonging to the types I, II, III, IV and V and having strength classes 42,5R and 52,5R according to the standard UNI EN 197/1. Preferably, according to a further aspect of the invention (cementitious composition), a suitable cement is selected among the cements belonging to the classes CEM II/A-L (or A-LL) 42,5R and CEM II/A-L (or A-LL) 52,5R; more preferably selected among the cements belonging to the class CEM II/A-L (or A-LL) 42,5R according to the standard UNI EN 197/1. According to a further aspect of the invention (cementitious composition), said suitable cement has a maximum diameter of the particles less than or equal to 100 microns, preferably less than 50 microns, still more preferably less than 30 microns. According to a further aspect of the invention, the percentage by weight of cement is preferably greater than 18%, more preferably greater than 21%; and/or is preferably less than 27%, more preferably is less than 25%; and/or is preferably comprised between 18% and 27%, more preferably is comprised between 21% and 25% with respect to the total weight of the composition.

Optionally, part of the cement can be substituted with II type additions according to the standard UNI EN 206-1: 2006, and particularly with silica fume, or fly ashes, or blast furnace slag, or pozzolana both natural and industrial, comprised between 1 and 3% by weight with respect to the total weight of the composition, preferably silica fume comprised between 1 and 3% by weight with respect to the total weight of the composition; in this case such additions of II type substitute part of the cement by a percentage comprised between 7 and 11% by weight of the cement. In such cases, instead of the "weight ratio between water and cement", it is considered the "weight ratio between water and equivalent cement" as established by the standard UNI EN 206-1: 2006, according to the following formula:

$$\text{water/equivalent cement}=\text{water}/(\text{cement}+k\times II\ \text{type addition}),$$

wherein k is a parameter specific according to the type of addition.

Therefore, the water/cement ratio of the cementitious composition of the present invention wherein from 7 to 11% by weight of the cement is substituted with II type additions, is comprised between 0.29 and 0.49. According to the further aspect of the invention, the at least one suitable inert aggregate is selected among fine aggregates, filler and mixtures thereof; preferably the filler is selected in case of I type additions according to the standard UNI EN 12620, more preferably the filler is selected between quartz sand, siliceous sand (microsilica) and calcareous filler (calcium carbonate). Preferably, according to a further aspect of the invention, the composition comprises a mixture of inert aggregates; more preferably comprises sand and quartz sand and/or calcareous filler. According to a further aspect of the invention, said sand is from 90% to 95% and said filler, preferably quartz sand or calcareous filler, is from 5% to 10% with respect to the total weight of the inert aggregates. According to a further aspect of the invention, preferably said sand has a maximum diameter less than 10 mm, still more preferably less than 6 mm, still more preferably less than 4 mm, according to the standard UNI 8520-1 for the compliance, and according to the standard UNI 2332 for determining the granulometric distribution. According to the further aspect of the invention, preferably said filler, preferably quartz sand or calcareous filler, has a maximum diameter less than 0.25 mm, preferably less than 0.125 mm, still more preferably less than 0.063 mm according to the standard UNI 8520-1 for the compliance and according to the standard UNI 2332 for determining the granulometric distribution. According to the further aspect of the invention, the percentage by weight of the at least one inert aggregate, alone or in a mixture with one or more other inert aggregates, is preferably greater than 63%, more preferably greater than 65%, and/or is preferably less than 79%, more preferably is less than 77%; and/or is preferably comprised between 63% and 79%, more preferably is comprised between 65% and 77% with respect to the total weight of the composition.

According to the further aspect of the invention, said at least one polymeric fiber is selected among polyolefinic fibers, preferably polypropylene (PP); polyvinyl alcohol (PVA); polyesters; aliphatic polyamides (Nylon); and mixtures thereof. Preferably, said at least one polymeric fiber is a polypropylene fiber (PP). Preferably, said at least one polymeric fiber, more preferably polypropylene (PP), has a diameter or a maximum size of the cross-section comprised between 0.12 and 0.8 mm, more preferably comprised between 0.25 and 0.35 mm. Preferably, said at least one polymeric fiber, more preferably polypropylene (PP), has a length less than 60 mm, more preferably comprised between 10 and 57 mm, still more preferably between 40 and 55 mm.

According to a further aspect of the invention, the percentage by weight of the at least one polymeric fiber, alone or in a mixture with one or more other polymeric fibers, is preferably greater than 0.025%, more preferably greater than 0.03%; and/or is preferably less than 0.6%, more preferably is less than 0.5%; and/or is preferably comprised between 0.025% and 0.6%, more preferably is comprised between 0.03% and 0.5% with respect to the total weight of the composition. Suitable polymeric fibers can be selected among those commercially available, for example those of the MapeFibre series marketed by Mapei, for example MapeFibre CN54 or NS12; those of the series RUREDIL marketed by RUREDIL, for example RUREDIL X FIBER 19; those of the Polifer series marketed by Polifer, for example Polifer 420. Without wishing to be bound by any explicative theory, the present inventors deem that said polymeric fibers have the function of contributing to the continuity of the flow of said composition exiting the supplying head 101, of providing the not already hardened slurry with tenacity and of decreasing the shrinkage effect of the cementitious composition. According to a further aspect of the invention, said at least one superfluidifying agent is selected among polymers optionally modified polycarboxylic polyethers, naphthalene sulfonic polyethers, polyphosphonics polyethers, acrylic polyethers, and polypropylene glycols, and mixtures thereof. Preferably, said at least one superfluidifying agent is a polymer possibly a modified polycarboxylic polyether.

According to a further aspect of the invention, said at least one fluidifying agent can be present as dust or in a liquid form, for example in an aqueous solution; preferably as dust, said dust has a density comprised between 50 and 80 g/100 $cm^3$, preferably comprised between 30 and 60 g/100 $cm^3$. Suitable superfluidifying agents are selected among those commercially available, for example among those of the Melflux® series marketed by BASF, such as for example Melflux® 2651F, and those of the series Dynamon® marketed by Mapei. According to a further aspect of the invention (cementitious composition), the percentage by weight of the at least one superfluidifying agent, alone or in a mixture with one or more other fluidifying agents, is preferably greater than 0.035%; and/or is preferably less than 0.05%; and/or is preferably comprised between 0.035% and 0.05% with respect to the total weight of the composition. According to the further aspect of the invention (cementitious composition), the percentage by mass of the at least one superfluidifying agent, alone or in a mixture with one or more other fluidifying agents, is preferably greater 0.02%, more preferably greater than 0.05%; and/or is preferably less than 0.15%, more preferably is less than 0.10%; and/or is preferably comprised between 0.02% and 0.15%, more preferably is comprised between 0.05% and 0.10% with respect to the total mass of the composition. According to the further aspect of the invention, the percentage by mass of the at least one superfluidifying agent, alone or in a mixture with one or more other fluidifying agents, is preferably greater than 0.1%, more preferably greater than 0.2%, still more preferably greater than 0.25%; and/or less than 0.65%, more preferably less than 0.5%, still more preferably less than 0.40%; and/or is comprised between 0.1% and 0.65%, more preferably is comprised between 0.2% and 0.5%, still more preferably is comprised between 0.25% and 0.40% with respect to the total mass of the cement. Without wishing to be bound by any explicative theory, the present inventors deem that the superfluidifying agent, added with specific quantities at the end of the mixing step in a mixer, adjusts the rheology and thixotropy of the cementitious composition. Particularly, such superfluidifying agent determines a low viscosity during the supplying step by the supplying head 101, for ensuring the printability of the cementitious composition, at the same time determines a high viscosity after the deposition of the composition in order to ensure in this way to separate the layers and support the layers successively deposited by the printing process. Moreover, the present inventors have noted that the superfluidifying dust is better distributed in the mixture and exerts the fluidifying effect in very few minutes after introducing it in the mixer (the effect is visible since it makes homogeneous and "pasty" the mixture). According to a further aspect of the invention, preferably the weight ratio between water and cement is comprised between 0.33 and 0.40. According to the further aspect of the invention, the cementitious composition can optionally comprise: natural or synthetic fibers besides those listed at the point (iii), for example short fibers of hemp, flax, jute; aerating agents, for example the Mapeair AE series marketed by Mapei; lightened inert aggregates having a maximum diameter less than 12.5 mm, such as for example Leca expanded (structural) clays; geopolymeric binders based on metakaolin and an aqueous solution of metal hydroxides (for example sodium hydroxide), such as for example setting accelerators, such as for example the Mapequick series of Mapei; hollow glass nanospheres. In a preferred embodiment, the cementitious composition—according to the further aspect of the present invention—comprises:

(i) from 15 to 30% by weight of cement with respect to the total weight of the composition, selected among those belonging to the types I, II, III, IV and V and having strength classes 42,5R and 52,5R according to the standard UNI EN 197/1;

(ii) from 60 to 80% by weight of at least one inert aggregate, alone or in a mixture with one or more other inert aggregates, with respect to the total weight of the composition, comprising sand and quartz sand or calcareous filler;

(iii) from 0.02 to 0.75% by weight of at least one polymeric fiber, alone or in a mixture with one or more other polymeric fibers, with respect to the total weight of the composition, selected among polyolefinic fibers, preferably polypropylene (PP); polyvinyl alcohol (PVA); polyesters; and aliphatic polyamides (Nylon);

(iv) from 0.03 to 0.1% by weight of at least one superfluidifying agent, alone or in mixture with one or more other superfluidifying agents, with respect to the total weight of the composition, selected among polymers optionally modified polycarboxylic polyethers, naphthalene sulfonic polyethers, polyphosphonics polyethers, and acrylic polyethers.

In a more preferred embodiment, the cementitious composition, according to the further aspect of the present invention, comprises:

(i) from 18 to 27% by weight of cement with respect to the total weight of the composition, selected among those belonging to the types I, II, III, IV and V and having strength classes 42,5R and 52,5R according to the standard UNI EN 197/1;

(ii) from 63 to 79% by weight of at least one inert aggregate, alone or in a mixture with one or more other inert aggregates, with respect to the total weight of the composition, comprising sand and quartz sand or calcareous filler;

(iii) from 0.025 to 0.6% by weight of at least one polymeric fiber, alone or in a mixture with one or more other polymeric fibers, with respect to the total weight of the composition, selected among polyolefinic fibers, preferably polypropylene (PP); polyvinyl alcohol (PVA); polyesters; and aliphatic polyamides (Nylon);

(iv) from 0.035 to 0.05% by weight of at least one superfluidifying agent, alone or in a mixture with one or more other superfluidifying agents, with respect to the total weight of the composition, selected among polymers optionally modified polycarboxylic polyethers, naphthalene sulfonic polyethers, polyphosphonics polyethers, and acrylic polyethers.

In a still more preferred embodiment, the cementitious composition comprises:

(i) from 21 to 25% by weight of cement with respect to the total weight of the composition, selected among those belonging to the types I, II, III, IV and V and having strength classes 42,5R and 52,5R according to the standard UNI EN 197/1;

(ii) from 65 to 77% by weight of at least one inert aggregate, alone or in a mixture with one or more other inert aggregates, with respect to the total weight of the composition, comprising sand and quartz sand;

(iii) from 0.03 to 0.5% by weight of at least one polymeric fiber, alone or in a mixture with one or more other polymeric fibers, with respect to the total weight of the composition, selected among polyolefinic fibers, preferably polypropylene (PP); polyvinyl alcohol (PVA); polyesters; and aliphatic polyamides (Nylon); preferably polypropylene (PP) fibers;

(iv) from 0.035 to 0.05% wt. of at least one superfluidifying agent, alone or in a mixture with one or more other superfluidifying agents, with respect to the total weight of the composition, selected among polymers optionally modified polycarboxylic polyethers, naphthalene sulfonic polyethers, polyphosphonics polyethers, and acrylic polyethers; preferably modified polycarboxylic polyether polymers. As an alternative, the cementitious composition of the invention can be defined based on the quantity expressed by kg of the components from (i) to (v) present in a cubic meter of said composition. The cementitious composition of the invention comprises:

(i) from 300 to 650 kg of cement per cubic meter of the composition, (ii) from 1,000 to 2,000 kg of at least one inert aggregate per cubic meter of the composition, (iii) from 0.5 to 2 kg of at least one polymeric fiber per cubic meter of the composition, (iv) from 0.5 to 2.8 kg of at least one superfluidifying agent per cubic meter of the composition, (v) from 100 to 200 liters of water per cubic meter of the composition.

The cementitious composition, according to the invention, falls into a consistency class S1. De facto, said composition in a green state, has a value of the Abrams cone slump test (SLUMP), measured according to the standard EN 12350-2:2009, comprised between 10 and 40 mm, preferably comprised between 30 and 40 mm. The cementitious composition according to the invention, hardened after curing for 28 days, has an average cubic strength value $R_{cm}$ and an average cylindrical strength $f_{cm}$, measured according to the standard EN 12390, comprised respectively between 50 and 60 MPa and between 40 and 48 MPa. A further aspect of the present invention comprises a method of preparing the cementitious composition according to the invention, comprising:

a) mixing the at least one inert aggregate (i) with the cement (ii), b) adding water to the obtained mixture and mixing in order to form a slurry, c) adding to the obtained slurry the at least one polymeric fiber (iii) and mixing, d) adding the at least one fluidifying agent (iv) and mixing.

According to a further aspect of the invention (method of preparing the cementitious composition), a suitable cement is selected among those belonging to the types I, II, III, IV and V, established by the standard EN 197-1, accepted at a national level by the standard UNI EN 197/1.

According to a further aspect of the invention, a suitable cement is selected among those belonging to the types I, II, III, IV and V and having strength classes 42,5R and 52,5R according to the standard UNI EN 197/1. Preferably, according to the further aspect of the invention (cementitious composition), a suitable cement is selected among those cements belonging to the classes CEM II/A-L (or A-LL) 42,5R and CEM II/A-L (or A-LL) 52,5R; more preferably selected among the cements belonging to the class CEM II/A-L (or A-LL) 42,5R according to the standard UNI EN 197/1. Said suitable cement has a maximum diameter of the particles less than or equal to 100 microns, preferably less than 50 microns, still more preferably less than 30 microns. According to the method of preparing the composition according to the invention, the at least one suitable inert aggregate is selected among sand, filler and mixtures thereof, preferably the filler is selected in the family of the I-type additives according to the standard UNI EN 12620, more preferably the filler is selected among quartz sand, silica sand (microsilica), and calcareous filler. According to the method of preparing the composition according to the invention, said sand has a maximum diameter less than 12.5 mm, preferably less than 10 mm, still more preferably less than 6 mm, still more preferably less than 4 mm, according to the standard UNI 8520-1 for the compliance and according to the standard UNI 2332 for determining the granulometric distribution. According to the method of preparing the composition according to the invention, said filler, preferably quartz sand or calcareous filler, has a maximum diameter less than 0.25 mm, preferably less than 0.125 mm, still more preferably less than 0.063 mm, according to the standard UNI 8520-1 for the compliance and according to the standard UNI 2332 for determining the granulometric distribution. According to the method of preparing the composition according to the invention, said at least one polymeric fiber is selected among polyolefinic fibers, preferably polypropylene (PP), polyvinyl alcohol (PVA); polyesters; aliphatic polyamides (Nylon); and mixtures thereof. Preferably, said at least one polymeric fiber is a polypropylene (PP) fiber. Preferably, said at least one polymeric fiber, more preferably a polypropylene (PP) fiber, has a diameter or a maximum dimension of the cross-section comprised between 0.12 and 0.8 mm, more preferably comprised between 0.25 and 0.35 mm. Preferably, said at least one polymeric fiber, more preferably polypropylene (PP), has a length less than 60 mm, more preferably comprised between 10 and 57 mm, still more preferably between 40 and 55 mm.

According to the method of preparing the composition in agreement with the invention, said at least one superfluidifying agent is selected among polymers optionally modified polycarboxylic polyethers, naphthalene sulfonic polyethers, polyphosphonic polyethers, acrylic polyethers, polypropylene glycols and mixtures thereof. Preferably, said at least one superfluidifying agent is a polymer possibly a modified polycarboxylic polyether. According to the method of preparing the composition in agreement with the invention, the mixing steps from a) to d) are performed at a speed comprised between 20 and 60 rounds per minute, more preferably between 30 and 50 rounds per minute. According to the method of preparing the composition in agreement with the invention, the mixing step a) and c) is extended for a time comprised between 10 seconds and 10 minutes, preferably between 1 minute and 7 minutes, more preferably between 2 minutes and 5 minutes. According to the method of preparing the composition in agreement with the invention, the mixing step b) is extended for a time comprised between 10 seconds and 10 minutes, preferably between 1 minute and 7 minutes, more preferably between 2 minutes and 5 minutes in which all the quantity of water is added; after adding water, the mixing step is extended for a time comprised between 10 seconds and 15 minutes, preferably between 1 minute and 10 minutes, more preferably between 2 minutes and 7 minutes. According to the method of preparing the composition in agreement with the invention, the mixing step d) is extended for a time comprised from 20 seconds to 20 minutes, preferably between 1 minute and 15 minutes, more preferably between 2 minutes and 13 minutes.

In a further aspect of the present invention, it is provided an use of the cementitious composition according to the invention for 3D printing modules/structures of reinforced cementitious material.

3.1 EXPERIMENTAL SECTION

Example 1

40 liters of a cementitious composition representative of the invention are prepared. In the step a), about 57.2 kg of sands (maximum diameter: 2 mm) and about 3.98 kg of quartz sand (maximum diameter: 0.125 mm) corresponding respectively to 1,431 kg and 99.5 kg per cubic meter of the final cementitious composition, are introduced into a cylindrical type electric mixer having a maximum capacity of 140 liters, beforehand wetted to saturation. Subsequently, about 19.9 kg of CEM II/A-LL 42.5 R corresponding to 498 kg per cubic meter of the final cementitious composition are added into the mixer, and then the dry powders are mixed for about 3 minutes, at a rotation speed of the mixer of about 40 rounds per minute. In the step b) water is gradually added, for a total of about 7 liters corresponding to 176.5 liters per cubic meter of the final cementitious composition, by mixing for a time corresponding to the addition of all the water quantity, corresponding to about 3 minutes at a rotation speed of the mixer of about 40 rounds per minute; then, the mixing step is extended for about other 5 minutes under the above given same rotation speed conditions of the mixer. In the step 5), polypropylene fibers (MapeFibre CN54, marketed by Mapei) in a quantity of 0.04 kg, corresponding to 1 kg per cubic meter of the final cementitious composition, are added and are mixed for approximately 3 minutes, at a mixer rotation speed of about 40 rounds per minute. In the step d), a quantity of 0.069 kg corresponding to 1.74 kg per cubic meter of the final cementitious composition, of the superfluidifying additive based on a modified polycarboxylic polyether (Melflux® 2651F marketed by BASF) is gradually added (⅓+⅓+⅓), and is mixed for further 5-10 minutes.

Example 2

Determining the consistency class of the cementitious composition prepared as described in the example 1 in a green state, measured according to the standard EN 12350-2:2009. The consistency class was measured by the Abrams cone, consisting of a cone made of galvanized steel or stainless steel having a thickness of about 1.5 mm and having a frustoconical shape with the following internal dimensions:

diameter of the lower base: 200±2 mm;
diameter of the upper base: 100±2 mm;
height: 300±2 mm.

The composition described in the example 1 in a green state (before being inserted in the printer) was quickly introduced and completely packed in the frustoconical container by following the suggestions of the cited standard. Immediately after removing the mould, the slump of the cone S was measured by the difference between the nominal height of the mould (hm=300 mm) and the height of the tallest point of the sample hs, by an approximation to the nearest 10 mm. The slum of the Abrams cone of the cementitious composition of the invention in a green state, was 34 mm, in other words said cementitious composition falls into the consistency class S1.

Example 3

Determining the average cubic strength value $R_{cm}$ and the average cylindrical strength value $f_{cm}$ of the cementitious composition prepared as described in the example 1, hardened after maturing for 28 days, measured according to the standard EN 12390. The average cubic strength $R_{cm}$ and the average cylindrical strength $f_{cm}$ under an uniaxial compression (by controlling the force) were measured on normalized specimens and therefore respectively on 4 cubic samples having a side of 150 mm and on 4 cylindrical samples having a diameter of 150 mm and a height of 300 mm. The average strength $R_{cm}$ of the cementitious composition of the invention hardened after curing it for 28 days, is of 53.5 MPa; the average strength $f_{cm}$ of the hardened cementitious composition itself after curing it for 28 days, is of 44.4 MPa. By the data given in the examples 2 and 3, it was found that the cementitious composition of the present invention in a green state, exhibits an optimal consistency, consequently such cementitious composition exhibits an optimal capacity of being supplied through the supplying head 101 and of remaining separated in layers and supporting the gradually printed layers. Moreover, such hardened cementitious composition has an optimal capacity of opposing to the compression, therefore is capable of compensating possible weaknesses of the connecting points between adjacent layers.

Example 4

Determining the average compression strength value $f_{cpm}$ of hollow cylindrical construction elements obtained by 3D-printing the cementitious composition prepared as described in the example 1 and hardened after curing it for 28 days. The cementitious composition of the invention was used for preparing three construction elements C1, C2 and C3, by the above described 3D-printing process of the present invention. Such construction elements are hollow cylinders, having a height of 200 mm, and average thickness of the walls of about 50 mm and being formed by 10 layers. The obtained thickness of the walls corresponds to a single layer of the material printed with the above described cementitious composition. The average outer ($D_{ext,\ ave}$) and inner diameters ($D_{int,\ ave}$) measured in mm of the three hollow cylinders, and also the average area ($A_{ave}$) of the cross-section measured in $mm^2$ from these latter, the average area ($A_{eff}$) of the effective transversal cross-section measured in $mm^2$ from the effective width of the transversal cross-section ($S_{eff}$, see FIG. 19) obtained by sectioning the specimens after the test, the recorded maximum force (or load) ($F_{max}$) measured in kN, the compression resistance calculated on the average area of the transversal cross-section ($f_{cp}$), measured in MPa, the average compression strength calculated on the average area of the cross-section ($f_{cpm}$) measured in MPa of the three construction elements C1, C2, and C3, the compression strength calculated on the average area of the effective cross-section ($f_{cp_eff}$) measured in MPa, the average compression strength calculated on the average area of the effective cross-section ($f_{cpm_eff}$) measured in MPA of the three construction elements C1, C2 and C3 are given in table 1.

TABLE 1

| Sample | $D_{ex}t_{,\ ave}$ mm | $D_{int,\ ave}$ mm | $A_{ave}$ $mm^2$ | $A_{eff}$ $mm^2$ | $F_{max}$ kN | $f_{cp}$ MPa | $f_{cpm}$ MPa | $f_{cp_eff}$ MPa | $f_{cpm_eff}$ MPa |
|---|---|---|---|---|---|---|---|---|---|
| C1 | 218 | 160 | 17039 | 11618 | 594 | 34.9 | 37.2 | 51.1 | 52.9 |
| C2 | 218 | 165 | 15763 | 10464 | 545 | 34.6 | | 52.1 | |
| C3 | 218 | 173 | 13776 | 10440 | 579 | 42.0 | | 55.4 | |

The average compression strength, if calculated on the average surface of the cross-section ($f_{cpm}$) of the three tested construction elements C1, C2 and C3, is 16% less than the average cylindrical strength $f_{cm}$ of the cementitious composition used for 3D-printing the construction element (37.2 MPa vs 44.4 MPa). The correct calculation performed by considering the effective area of the cross-section, in other words by considering only the net surface in contact with the layers (determined by the segment S_eff shown in the cross-section view of the cylindrical specimen of FIG. 19), gives results entirely corresponding to the ones regarding the average cubic strength $R_{cm}$ of the cementitious composition used for 3D-printing the construction element (52.9 MPa vs. 3.5 MPa). From the data of the example 4, it was found that the material in its printed shape, holds its compression strength capability shown in the "bulk" condition of the cubic specimens.

Example 5

Determining the flexural rigidity value of a three-dimensional structure obtained by 3D-printing the cementitious composition prepared as described in the example 1.

The cementitious composition of the invention was used for preparing, from a determined 2D profile, a three-dimensional structure (INV) long 3.20 m having an overall rectangular cross-section with a width of 0.20 m and a height of 0.40 m, formed by 7 modules, made by the 3D-printing process of the present invention, as shown in FIG. 1. The total weight of the three-dimensional structure (INV) was of 2.9 kN, corresponding to q=0.9 kN/m of the distributed weight. The weight of the three-dimensional structure (INV) corresponds to 45% of the weight of the equivalent solid structure (RIF), the cross-section thereof has the same dimensions, in other words 0.20 m and 0.40 m, and the same longitudinal steel reinforcement, in other words two bars with a diameter of 10 mm and a cover of 40 mm. The flexural rigidity of both structures (INV) and (RIF) was calculated for understanding the possibilities of this technology of designing and printing a beam obtained by modules having a particular shape, as shown in FIG. 1. Particularly, the deflection f (or transversal displacement of the axis) of the beam of the structure (INV) was measured at the midline cross-section of the same, under the effect of the own load of the structure abutting on two ends. The measurement was performed by a decimal comparator. The equivalent flexural rigidity (E/eq) of the structure of the invention (INV) was determined by the classic elastic theory of the continuous (solid) beams with rectilinear axis by the following known relationships between the deflection and load applied to the beam (for beams constrained by supports at the ends):

$$f=5*ql^4/(384*EI)\rightarrow EI_{eq}=5*ql^4/(384*f)$$

wherein the value of the (own) load of the beam q and the length thereof I, and the measure deflection f are known; wherein EI is the flexural rigidity, in other words E represents the Young module of the material, and I represents the moment of inertia of the cross-section.

Table 2 shows the flexural rigidity values EI of the three-dimensional structure of the invention (INV) and of said equivalent solid structure (RIF) when is uncracked (RIF1, the percentage of cracks is less than 50%) and when is cracked (RIF2, the percentage of cracks is greater than 60%).

TABLE 2

| Structure | EI $N/mm^2$ |
|---|---|
| INV | $1.20 * 10^{13}$ |
| RIF1 | $2.6 * 10^{13}$ |
| RIF2 | $0.13 * 10^{13}$ |

The flexural rigidity value of the structure of the invention is intermediate between the one of the solid uncracked structure (RIF1) and of the cracked one (RIF2), this latter was evaluated according to the "Norme Tecniche per le Costruzioni (NTC2008)".

From the data shown in the example 5, it was found that, despite the cavities present in the modules printed according to the process of the invention and the smaller quantities of cementitious material present in the structure of the invention could determine a too high deformability of the structure, the present inventors have surprisingly found that the deformability of such structure amounts to acceptable values. This is an interesting result because enables to better exploit the possibilities of the 3D printing for designing shapes which are, at the same time, structurally efficient and characterized by a low use of cementitious material.

Finally, the cementitious composition of the present invention, characterized by the specific quantity of components from (i) to (v), particularly characterized by the ratio between the water quantity and cement quantity, by the quantity of superfluidifying agents and by the granulometry of the inert aggregates, is particularly suitable for making structures of reinforced cementitious material obtained by the 3D printing process of the present invention.

The invention claimed is:

1. A process of making a structure of reinforced cementitious material comprising the following steps:

making, by a three-dimensional printing process, a plurality of modules of cementitious material, said three-dimensional printing process comprising a step of depositing a plurality of layers of cementitious material one on another according to a stratification direction, said plurality of modules comprising:

at least one first module comprising at least one lateral wall delimited by an outer surface and extending along the stratification direction, at least part of said outer lateral surface of the first module defining a reciprocal coupling surface, said first module further comprising at least one hooking portion defining at least one cavity extending at least partially along the stratification direction, and at least one second module comprising at least one lateral wall delimited by an outer surface and extending along the stratification direction, at least part of the outer surface of the second module defining a reciprocal coupling surface countershaped to the reciprocal coupling surface of the outer surface of the first module, said second module further comprising at least one hooking portion defining at least one cavity extending at least partially along the stratification direction;

bringing in contact the first and second modules so that respective coupling reciprocal surfaces of the first and second modules abut on each other;

following the step of contacting the first and second modules, engaging at least one connecting element, on one side, inside the cavity of the hooking portion of the first module and, on another side, inside the cavity of the hooking portion of the second module, said connecting element constraining the first and second modules and being configured for holding the first and second modules in contact with each other, wherein the connecting element comprises:

at least one reinforcing bar extending along a longitudinal development direction between a first and second end portions, at the first end portion, a first engagement portion emerging from the reinforcing bar transversally to the longitudinal development direction of the reinforcing bar, and at the second end portion, a second engagement portion emerging from the reinforcing bar transversally to the longitudinal development direction of the reinforcing bar, wherein the first and second engagement portions of the connecting element are distinct and removably associable to the reinforcing bar, engaging the first and second engagement portions in the first and second modules respectively; and after engaging the first and second engagement portions in the first and second modules, constraining the reinforcing bar to said first and second engagement portions, wherein the step of engaging the connecting element to the first and second modules comprises the following sub-steps:

engaging the first engagement portion inside the cavity of the hooking portion of the first module, and engaging the second engagement portion inside the cavity of the hooking portion of the second module.

2. The process according to claim 1, wherein the step of engaging the first engagement portion to the first module comprises at least the following sub-steps:

inserting the first engagement portion inside the cavity of the hooking portion of the first module, filling at least partially the cavity of the hooking portion of the first module with a cementitious material at least partially at a liquid state so that the cementitious material can contact at least part of said first engagement portion, constraining, by hardening the cementitious material inside the cavity of the first module, said first engagement portion, and wherein the step of engaging the second engagement portion to the second module comprises at least the following sub-steps:

inserting the second engagement portion inside the cavity of the hooking portion of the second module, filling at least partially the cavity of the hooking portion of the second module with a cementitious material at least partially at a liquid state so that the cementitious material can contact at least part of said second engagement portion, constraining, by hardening the cementitious material inside the cavity of the second module, said second engagement portion.

3. The process according to claim 1, comprising, after the step of engaging the connecting element with the first and second modules, a further step of fixing the first and second modules having the following sub-steps:

providing between the reciprocal coupling surfaces of the first and second modules, a predetermined quantity of cementitious material at least partially at a liquid state, further constraining, by hardening said cementitious material disposed between the reciprocal coupling surfaces, said first and second modules.

4. The process according to claim 1, wherein the step of depositing, by a three-dimensional printing process, the plurality of layers of cementitious material one on another according to the stratification direction, comprises a superimposing of layers exhibiting substantially a same shape and size, each module exhibiting, according to the stratification direction, a substantially constant cross-section for defining a profile.

5. The process according to claim 1, wherein the lateral wall of the first module defines a closed outer perimeter, and the lateral wall of the second module defines a closed outer perimeter, the hooking portion of said first module is defined inside said closed outer perimeter and extends for all a development of the first module along the stratification direction, the hooking portion of said second module is defined inside said closed outer perimeter and said hooking portion extends for all a development of the second module along the stratification direction.

6. The process according to claim 1, wherein the step of depositing the cementitious material by the three-dimensional printing, is adapted to define a first hollow module with a closed outer perimeter, said depositing step further comprising a step of defining, inside the closed outer perimeter of the first module, a reinforcing portion, said reinforcing portion extending inside the closed outer perimeter of the first module between two sides of said closed outer perimeter, substantially opposite to each other.

7. The process according to claim 6, wherein the reinforcing portion extends along the stratification direction of the first module and defines, cooperatively with the lateral wall of the first module, at least one first and one second through seats.

8. The process according to claim 1, wherein the step of depositing the cementitious material by the three-dimensional printing, defines a second hollow module having a closed outer perimeter, said depositing step further comprising a step of defining, inside the closed outer perimeter of the second module, a reinforcing portion, said reinforcing portion extending inside the closed outer perimeter of the second module between two sides of said closed outer perimeter substantially opposite to each other.

9. The process according to claim 8, wherein the reinforcing portion of the second module extends along the stratification direction of the second module itself and defines, cooperatively with the lateral wall of the second module, at least one first and one second through seats.

10. The process according to claim 1, wherein the second module comprises a further reciprocal coupling surface opposite to the reciprocal coupling surface of the second module, said plurality of modules comprises at least one third module comprising at least a lateral wall delimited by an outer surface and extending along the stratification direction, at least part of the outer surface of the third module defining a reciprocal coupling surface counter-shaped to the further reciprocal coupling surface of the second module, said third module further comprising at least one hooking portion defining at least one cavity extending at least partially along the stratification direction, said process further comprising the following steps:

bringing in contact the second and third modules so that the further reciprocal coupling surface of the second module and the reciprocal coupling surface of the third module abuts on each other, the third module being opposite to the first module with respect to the second module, after the step of contacting the second module with the third module, engaging at least one connecting element, on one side, inside the cavity of the hooking portion of the second module and, on another side, inside the cavity of the hooking portion of the third module, said connecting element constraining the second module and third module, and being configured for holding the second and third modules in contact with each other.

11. The process according to claim 10, wherein the connecting element of the second and third modules comprises at least one reinforcing bar extending along a longitudinal development direction between a first and second end portions, said connecting element comprising—at the first end portion—a first engagement portion emerging from the reinforcing bar transversally to the longitudinal development direction of the reinforcing bar, said connecting element further comprising—at the second end portion—a second engagement portion emerging from the reinforcing bar transversally to the longitudinal development direction of the reinforcing bar, the step of engaging the connecting element with the second and third modules comprises at least the following sub-steps:

engaging the first engagement portion inside the cavity of the hooking portion of the second module, engaging the second engagement portion inside the cavity of the hooking portion of the third module.

12. The process according to claim 11, wherein the step of engaging the first engagement portion with the second module comprises at least the following sub-steps:

inserting the first engagement portion inside the cavity of the hooking portion of the second module, filling at least partially the cavity of the hooking portion of the second module with a cementitious material at least partially at a liquid state so that the cementitious material can contact at least part of said first engagement portion, constraining, by hardening the cementitious material inside the cavity of the second module, said first engagement portion, and wherein the step of engaging the second engagement portion with the third module comprises at least the following sub-steps:

inserting the second engagement portion inside the cavity of the hooking portion of the third module, filling at least partially the cavity of the hooking portion of the third module with a cementitious material at least partially at a liquid state so that the cementitious material can contact at least part of said second engagement portion, constraining, by hardening the cementitious material inside the cavity of the third module, said second engagement portion.

13. The process according to claim 11, wherein the first and second engagement portions of the connecting element of the second and third modules, are distinct and removably associated to the reinforcing bar, the process comprises the steps of engaging said first and second engagement portions respectively in the second and third modules and after a step of constraining the reinforcing bar to said first and second engagement portions.

14. The process according to claim 10, wherein the lateral wall of the third wall defines a closed outer perimeter, wherein the hooking portion of the third module is defined inside said closed outer perimeter, and said hooking portion extends for all a development of the third module along the stratification direction.

15. The process according to claim 10, wherein the step of depositing the cementitious material by the 3D printing, defines a third hollow module having a closed outer perimeter, said depositing step further comprising a step of defining, inside the closed outer perimeter of the third module, a reinforcing portion, said reinforcing portion extending inside the closed outer perimeter of the third module between two sides of said closed outer perimeter, substantially opposite to each other, wherein the reinforcing portion extends along a stratification direction of the third module and defines, cooperatively with the lateral wall of the third module, at least one first and one second through seats.

16. The process according to claim 10, comprising the step of engaging at least one connecting element, on one side, inside the cavity of the hooking portion of the first module and, on another side, inside the cavity of the hooking portion of the third module, said connecting element constraining the first module and third module.

17. The process according to claim 1, wherein the process comprises—after the step of engaging the connecting element with the second and third modules—a step of further fixing the second and third modules which provides at least the following sub-steps:

providing between the further reciprocal coupling surface of the second module and the reciprocal coupling surface of the third module, a predetermined quantity of a cementitious material at least partially at liquid state, and further constraining, by hardening said cementitious material disposed between said further reciprocal coupling surfaces, said second and third modules.

18. The process according to claim 1, wherein the step of depositing, by a three-dimensional printing process, the plurality of layers of cementitious material, one on another along the stratification direction comprises a step of overlapping layers exhibiting substantially a same shape and size, each module exhibiting, along the stratification direction, a substantially constant cross-section for defining a profile.

* * * * *